US007815555B2

(12) United States Patent
Webber et al.

(10) Patent No.: US 7,815,555 B2
(45) Date of Patent: Oct. 19, 2010

(54) DUAL ACTION WEIGHTLIFTING MACHINE

(75) Inventors: Randall T. Webber, La Jolla, CA (US); Bruce Hockridge, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 224 days.

(21) Appl. No.: 11/940,009

(22) Filed: Nov. 14, 2007

(65) Prior Publication Data

US 2009/0124469 A1 May 14, 2009

(51) Int. Cl.
*A63B 21/078* (2006.01)
*A63B 21/072* (2006.01)

(52) U.S. Cl. ..... 482/104; 482/106; 482/107; 482/108

(58) Field of Classification Search ..... 482/92–100, 482/104–108, 135, 138; D21/673, 675, 679, D21/681, 686; 182/104, 135
See application file for complete search history.

(56) References Cited

U.S. PATENT DOCUMENTS

| | | | | |
|---|---|---|---|---|
| 3,235,255 | A | 2/1966 | LeFlar | |
| 4,564,194 | A | 1/1986 | Dawson | |
| 4,795,149 | A * | 1/1989 | Pearson | 482/98 |
| 4,836,535 | A | 6/1989 | Pearson | |
| 5,050,868 | A | 9/1991 | Pearson | |
| 5,135,453 | A * | 8/1992 | Sollenberger | 482/101 |
| 5,184,992 | A | 2/1993 | Banks | |
| 5,215,510 | A | 6/1993 | Baran | |
| 5,273,506 | A | 12/1993 | Dawson, Jr. | |
| 5,334,120 | A * | 8/1994 | Rasmussen | 482/97 |
| 5,569,133 | A | 10/1996 | Vittone | |
| 5,669,859 | A * | 9/1997 | Liggett et al. | 482/94 |
| D454,930 | S | 3/2002 | Novak | |
| 6,623,409 | B1 | 9/2003 | Abelbeck | |

(Continued)

FOREIGN PATENT DOCUMENTS

WO WO92/22357 12/1992

OTHER PUBLICATIONS

U.S. Appl. No. 11/929,372, filed Oct. 30, 2007, Webber, not yet published.

(Continued)

*Primary Examiner*—Lori Baker
(74) *Attorney, Agent, or Firm*—Procopio, Cory, Hargreaves & Savitch LLP

(57) ABSTRACT

A dual action weightlifting machine has a stationary main frame assembly comprising a right side frame and a left side frame on opposite sides of an exercise area, and a traveling frame movably supported on the stationary frame assembly and having right and left sides and a cross bar connecting the right and left sides above the exercise area, each side of the traveling frame having a vertical guide. A weight bearing exercise bar is movably supported on the traveling frame and has spaced first and second vertical slides slidably mounted on the right and left vertical guides. A horizontal slide assembly has dual horizontal guides on each side frame which engage dual slides on each side of the traveling frame. The horizontal slide assembly is located in a lower portion of the stationary frame assembly completely below the vertical travel path of a user engaging portion of the weight bearing exercise bar.

25 Claims, 31 Drawing Sheets

U.S. PATENT DOCUMENTS

| | | | | |
|---|---|---|---|---|
| 6,685,601 | B1 | 2/2004 | Knapp | |
| 6,811,521 | B1 | 11/2004 | Musso | |
| 6,926,649 | B2 | 8/2005 | Slawinski | |
| D512,471 | S | 12/2005 | Panatta | |
| 6,974,039 | B2 | 12/2005 | Comartin et al. | |
| 7,014,601 | B2 | 3/2006 | Savage et al. | |
| 7,131,937 | B2 | 11/2006 | Skilken et al. | |
| D560,089 | S | 1/2008 | DeMeyer | |
| 7,331,911 | B2 * | 2/2008 | Webber et al. | 482/137 |
| 7,374,516 | B2 * | 5/2008 | Lundquist | 482/104 |
| 7,393,309 | B2 * | 7/2008 | Webber | 482/104 |
| D583,426 | S | 12/2008 | Webber | |
| D590,032 | S | 4/2009 | Webber | |
| 2007/0042876 | A1 | 2/2007 | Lundquist | |
| 2007/0203002 | A1 | 8/2007 | Webber | |

OTHER PUBLICATIONS

U.S. Appl. No. 29/297,619, filed Nov. 14, 2007, Webber et al, not yet published.
U.S. Appl. No. 29/297,625, filed Nov. 14, 2007, Webber et al, not yet published.
Super Smith 11, Hard Kore brochure, date unknown.
Floating Smith, Serious Lifting Brochure, p. 7, date unknown.
Natural Motion Self Spotting Free Weight Machine, Max Rack Brochure, date unknown.
3-D Smith, Max Rack flyer, date unknown.
The Jones Machine, Bodycraft website, http://www.bodycraft.com/jones.tpl, earliest date of publication unknown.
The Slammer, Positrak brochure, date unknown.
Smith Machine PFW-7700, Paramount Fitness 2002.
Smith Machine FSSM, Life Fitness 2005.
Multi-Adjustable Bench FB31, Life Fitness 2002.
Hoist Full Cage and Half Cage Ensemble, Hoist Fitness Systems Catalog, 2000.
HFOPT 900-02, pages from Owner's Manual, Jan. 2000.
The Max Rack Squat Machine, Date unknown.
LS545 Max Rack, Lamar Health, Fitness & Sports LLC (Date unknown).
Criterion Bodybuilding Brochure, Leg Machine; Shoulder Machine; Back Machine; Chest Module, Criterion Body Building Machines, Date unknown.

* cited by examiner

DUAL ACTION WEIGHTLIFTING MACHINE

BACKGROUND

1. Field of the Invention

The present invention relates generally to weightlifting exercise machines, and is particularly concerned with dual action exercise machines which have a guided exercise bar or weight bar to simulate free weight barbell exercise movements.

2. Related Art

Weightlifting machines with weight bars for simulating barbells, also known as Smith machines, have been a fitness club staple for many years. The basic machine has a barbell attached to slide mechanisms which run on vertical guides on opposite sides of a stationary frame. This allows an exerciser to perform exercises with vertical up and down movement, such as squats, bench press exercises, and the like, but does not permit any horizontal movement. The exerciser does not have to worry about balancing the side-to-side or front-to-back movement of an independent, free weight bar. The premise is that this design provides an additional measure of safety and is easy for the neophyte to use.

The first Smith machines had the vertical guides running perpendicular to the floor, which worked well for some exercises such as squats but fought the natural chest-to-chin arcing movement of a bench press. Manufacturers soon started designing Smith machines that placed the vertical guides at a slight (five to seven degrees) angle. These new designs worked better for exercises which involved travel in a slight arc, but not as well for other exercise motions which tended to follow a straight line.

The next evolution came with the advent of composite motion or dual action Smith machines that provided simultaneous horizontal and vertical exercise motion. These designs allowed the exercise bar to follow a natural front-to-back exercise motion but still eliminated the side-to-side balancing worries. They provided a halfway point between the balance and coordination needed to perform free weight exercises and the security of a traditional Smith machine. These designs also provided the ability to perform exercises such as lunges which require greater horizontal movement.

Dual motion weightlifting machines typically have a horizontal exercise bar which is slidably mounted at its opposite ends on two vertical guide bars. Each vertical guide bar in turn is slidably mounted on horizontal guide bars at its upper and lower ends. This allows the exercise bar to move simultaneously in vertical and horizontal directions, so that the exerciser can perform a more natural feeling weightlifting exercise which allows for the natural horizontal movements of the arms while pushing a weight upwards. The weight bearing bar or exercise bar is normally a standard Olympic bar, which may have hooks attached to it on a rotatable sleeve for hooking onto pinning holes on vertical guides so as to hold the bar in a rest position. The usual weight for an Olympic bar is between forty and fifty pounds. By attaching hooks, bearings, and vertical slides, the weight is dramatically increased. In some cases, counterweights are added to help reduce the weight or inertia required to move the bar from a rest position. While this counterbalance offsets the vertical weight, horizontal weight is increased. It also adds to the complexity and expense of the machine.

Some prior designs, such as U.S. Pat. No. 5,050,868 of Pearson, have a traveling frame comprising two pairs of vertical uprights, each pair secured to a single lower slide engaging a lower side frame member on a respective side of the frame. This design eliminates the upper horizontal slides and guides. However, the traveling frame is relatively heavy. The vertical uprights are joined together by two upper cross supports which telescope to allow for misalignment during horizontal movement. A racking system for holding the exercise bar when not in use and a safety stop bar also travel with the traveling frame, adding to the weight.

In U.S. patent application Ser. No. 11/363,677 of Webber et al., for a Dual Action Weightlifting Machine, filed on Feb. 28, 2006, an exercise bar assembly has vertical slides mounted on a pair of vertical guides. Horizontal slides are mounted to the vertical guides at their lower end. The upper ends of the guides are connected by a cross bar which has a horizontal slide mounted at an intermediate position in its length. The three horizontal slides are mounted on guides affixed to the stationary frame.

SUMMARY

According to one embodiment, a dual action weightlifting apparatus for performing simultaneous horizontal and vertical exercise movement is provided, which comprises a stationary main frame assembly; a traveling frame movably supported on the stationary frame assembly; and a weight bearing exercise bar, movably supported on the traveling frame. The stationary frame assembly comprises a right and left side frame connected together by one or more cross supports. The traveling frame includes first and second spaced vertical guides and an exercise bar assembly having spaced first and second vertical slides slidably mounted on the vertical guides for vertical sliding movement relative to the frame. A horizontal slide assembly which slidably connects the traveling frame to the right and left side frames of the stationary frame assembly is located completely below the vertical travel path of the weight bearing exercise bar.

In one embodiment, the horizontal slide assembly comprises a dual low position horizontal guide system on each side of the frame for added stability. The dual horizontal guide system comprises first and second horizontal guides mounted on each side framework below the lower vertical position of the exercise bar assembly, and the traveling frame has left and right slides which engage with the dual left and right horizontal guides for horizontal movement relative to the main frame assembly. The dual low position horizontal guides on each side of the frame assembly provide stability and keep the moving parts out of the way of the exerciser. Bulky overhead guide systems which are found on some prior art machines are eliminated in this embodiment, reducing the weight of the traveling frame and making it easier for the exerciser to overcome inertia and change directions.

The stationary frame assembly in one embodiment also includes a racking system which engages the exercise bar in a rest position of the traveling frame, and may also include a safety stop for restricting downward vertical movement of the exercise bar below a selected vertical elevation. This arrangement does not require any racking system or safety bars to travel with the traveling frame, further simplifying the frame and reducing its weight.

In one embodiment, each side frame comprises a first floor engaging vertical upright, a second floor engaging vertical upright, and a horizontal base tube joining the first and second vertical uprights in the vicinity of the lower ends of the vertical uprights. A stationary safety stop bar spans the distance between the two vertical uprights above the first base tube and is positioned at a higher elevation than the two horizontal guides. The second vertical uprights each have a series of spaced teeth facing the traveling frame to provide the racking system which has various "rack out" positions for the exercise bar. An adjustable safety bar designed to span the distance between the two vertical uprights may also be provided, with one end engaging holes located in the first upright and the second end engaging the second uprights toothed plate. A support frame which supports the second upright struts is located at the second end of the frame, and has left and right curved uprights which curve upwardly and forward and connect with upper end of the second or rear vertical upright of the left and right frame, respectively.

In one embodiment, the traveling frame comprises right and left side components connected together by an upper cross support. Each side component consists of a vertical upright, first and second horizontal slides and the vertical guide.

Fully assembled, the traveling frame is slidably engaged via its slides to the horizontal guides on the stationary main frame for horizontal movement relative to the main frame. The exercise bar is slidably engaged via its slides with the vertical guides on the traveling frame for vertical movement relative to the traveling frame. The teeth on the second vertical uprights act as storage or rest positions when the bar is not in use and allow the user to match the starting position of the bar based on their height and/or the type of exercise being performed. Once the user engages the weight bearing bar, horizontal and vertical movements can be performed simultaneously. The exercise bar assembly is designed to engage directly onto the teeth on the second vertical uprights of the stationary main frame without the use of secondary hooks, latches or catch mechanisms.

In one embodiment, a pair of horizontal guides is provided on the left and right side of the frame, and a respective horizontal slide is slidably mounted on each horizontal guide, so that there are a total of four horizontal slides, all located adjacent a lower end of the frame and below the user engagement portion of the exercise bar assembly when the exercise bar assembly is in the lowest position. In one embodiment, the pair of horizontal guides and the corresponding horizontal slides on each side of the frame are vertically stacked so that they are in the same vertical plane but different horizontal planes. In another embodiment, each pair of horizontal guides is located side-by-side in the same horizontal plane but different vertical planes. In yet another embodiment, the guides in each pair may be at different elevations and also horizontally spaced, i.e. lying in different horizontal and vertical planes. The traveling framework may be mounted to both horizontal slides of each pair, or may be mounted to only one of the horizontal slides on each side of the frame, with the horizontal slides on each side linked together to travel in unison.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
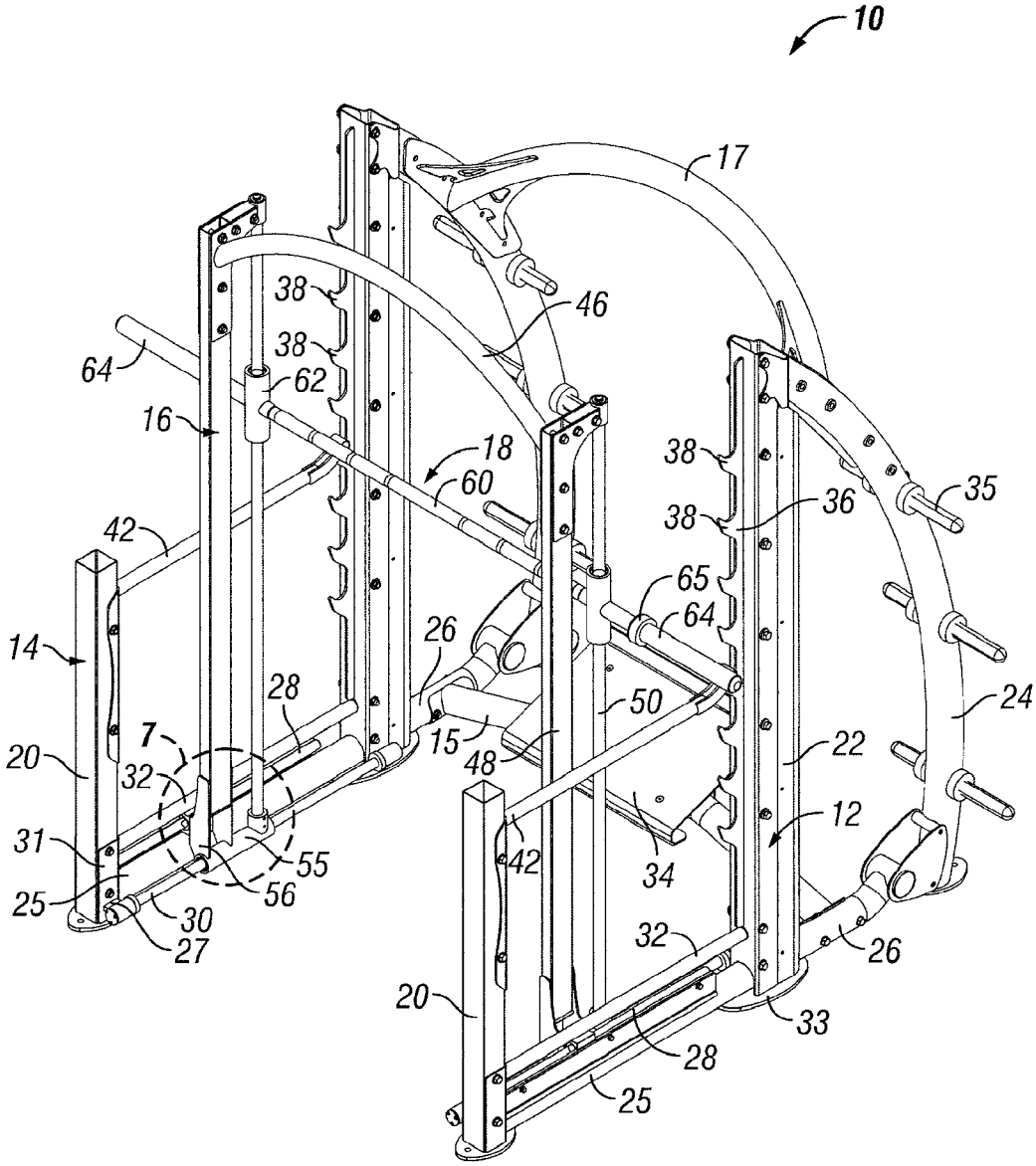
FIG. 1 is a front perspective view of a dual action weightlifting machine according to a first embodiment.

Certain embodiments as disclosed herein provide for a dual action weightlifting machine which has a stationary main frame, a traveling frame which is slidably mounted for horizontal sliding movement relative to the main frame on a dual horizontal slide assembly located only at a lower region of the main frame, and a weight bearing exercise bar slidably mounted for vertical sliding movement on the traveling framework above the horizontal slide assembly, with the exercise bar having a user engaging portion.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 7 illustrate one embodiment of a dual action weightlifting exercise machine 10. Machine 10 basically comprises a stationary main frame assembly having opposite left and right side frames 12, 14 connected by a lower cross strut or support 15 and an upper cross strut or support 17, a traveling frame 16 which is slidably mounted for horizontal sliding movement on the side frames, and a weight bearing exercise bar assembly 18 which is slidably mounted for vertical sliding movement on the traveling frame. An exercise area is located between the left and right side frames and a user stands in this area when performing exercise. A forward end of the stationary frame assembly is open to allow users to easily enter and exit the exercise area.

Each side frame 12, 14 has a first or front ground engaging upright 20, a second ground engaging upright 22 which is taller than the first upright, and a rear upright support 24 which curves upwardly and forwardly from its lower, ground engaging end and has an upper end secured to the upper end of the second upright. A first horizontal base tube 25 extends between the first and second vertical uprights at a location proximate their lower, floor engaging ends. A second base tube 26 extends between the second vertical upright and the rear support proximate their lower, ground engaging ends. Lower cross support 15 extends between opposing portions of the second base tubes 26.

A horizontal slide assembly slidably connects opposite sides of the traveling frame to the right and left side frames for guided horizontal sliding movement of the traveling frame. In this embodiment, the horizontal slide assembly includes first and second horizontal guides 28, 30 mounted on each side frame. The horizontal guides 28, 30 extend generally between the first and second uprights at the lower end portion of the respective side frame, parallel to the first base tube. Each horizontal guide 28,30 is slidably engaged by a respective horizontal slide 54, 55 associated with the traveling frame, as described in more detail below with reference to FIG. 7.

Figure 4:
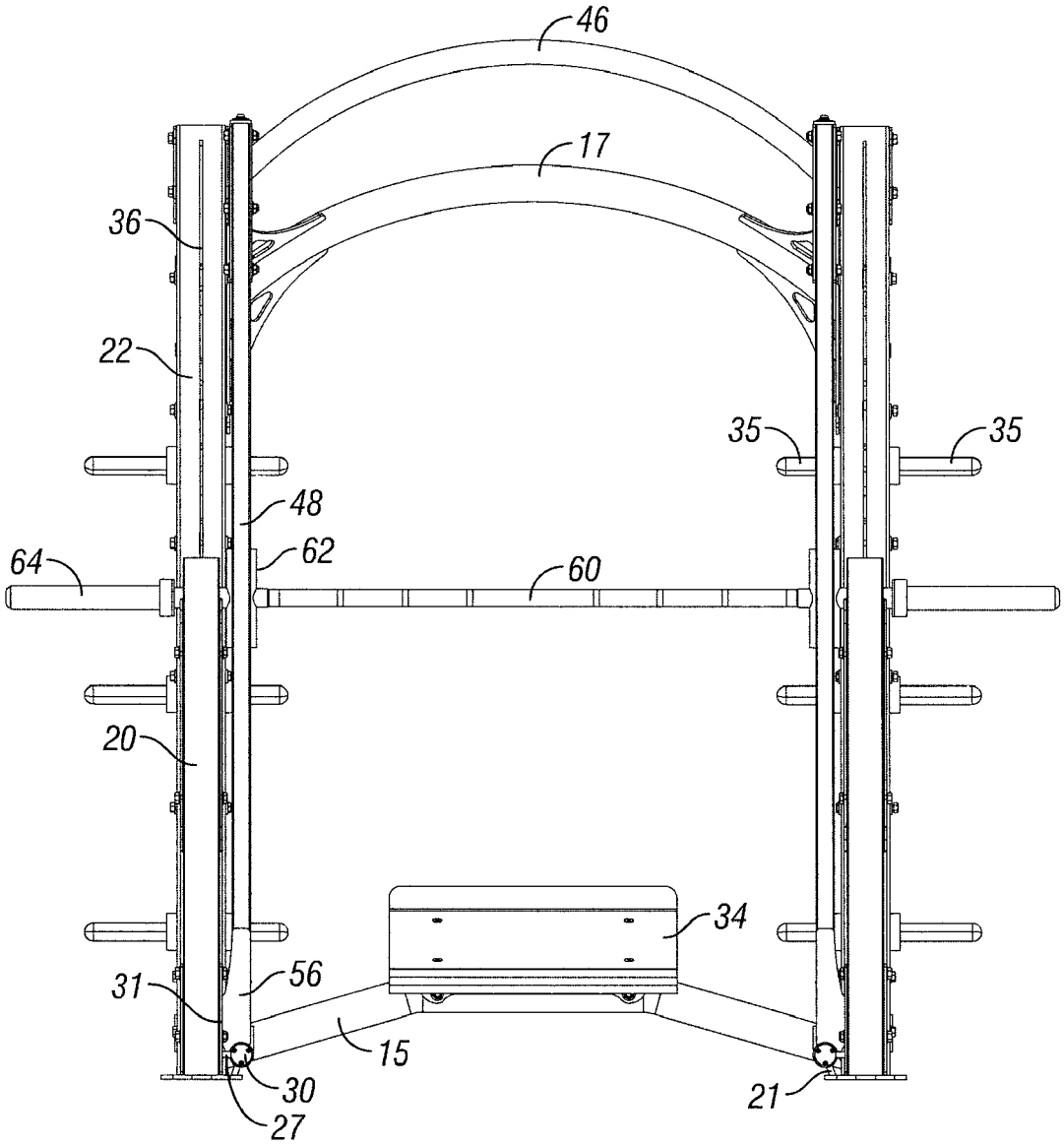
FIG. 4 is a front elevation view of the machine of FIGS. 1 to 3.
Figure 5:
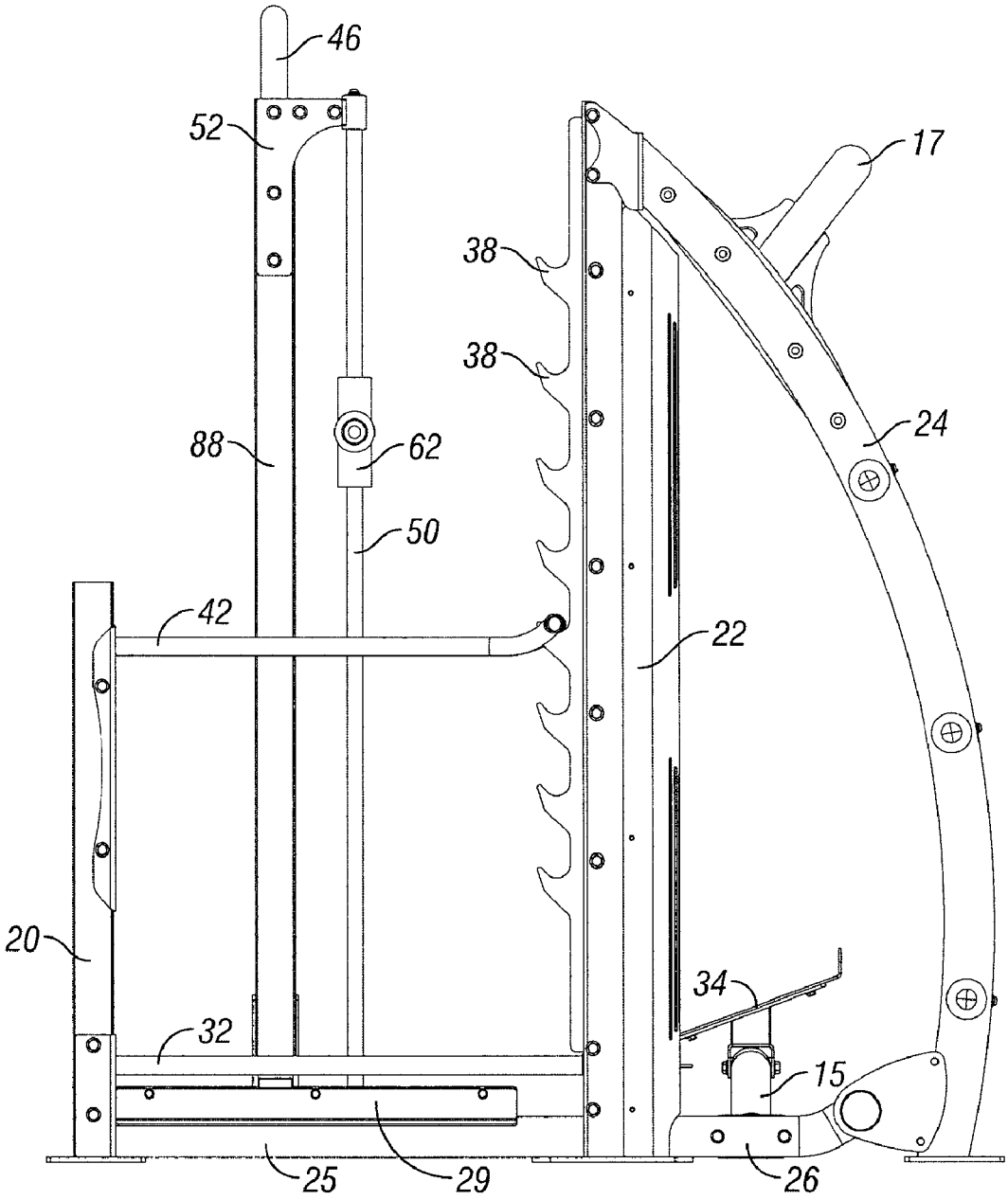
FIG. 5 is a side elevation view of the machine of FIGS. 1 to 4 with the movable frame positioned away from the vertical uprights and the exercise bar depicted in an exercise position.
Figure 6:
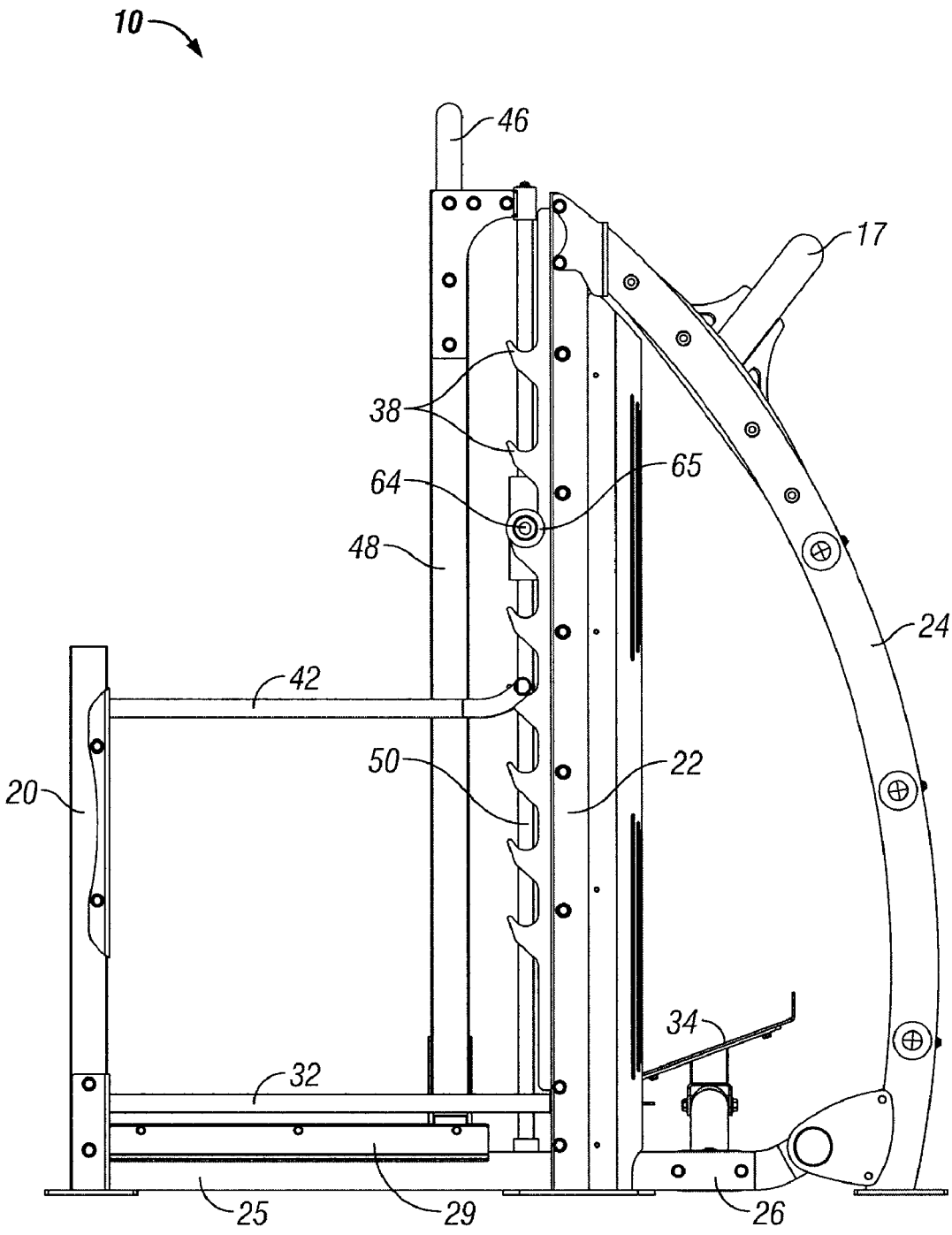
FIG. 6 is a side elevation view similar to FIG. 5 but with the movable frame positioned up against the second or rear vertical uprights and the exercise bar engaging a pair of aligned teeth in the second vertical uprights in a racked out or storage position.

The first horizontal guide 28 is mounted via a standoff to a plate 29 attached the first base tube 25 (see FIG. 6). The second horizontal guide 30 is spaced inboard from the first horizontal guide 28 and is at a lower elevation. Second horizontal guide 30 is mounted at one end via stand-off 27 on mounting bracket 31 which attaches the first base tube 25 to the first upright. The other end of horizontal guide 30 is secured via stand-off 21 to the floor engaging plate 33 of the second upright 22, as illustrated in FIG. 4. A stationary safety stop bar 32 spans the distance between the first and second uprights above the first base tube 25 and is positioned at a higher elevation than the two horizontal guides 28, 30. Upper cross support 17 is curved upwardly between its ends and extends between upper end portions of the rear supports.

An angled plate 34 is mounted in the raised, central region of cross support 15, which allows a user to perform a lunge exercise. Plate 34 may be fixed in place or may be arranged to swing into and out of the exercise position, and may be a permanent station or an optional attachment. Plate 34 may have a single exercise position or multiple exercise positions.

Figure 2:
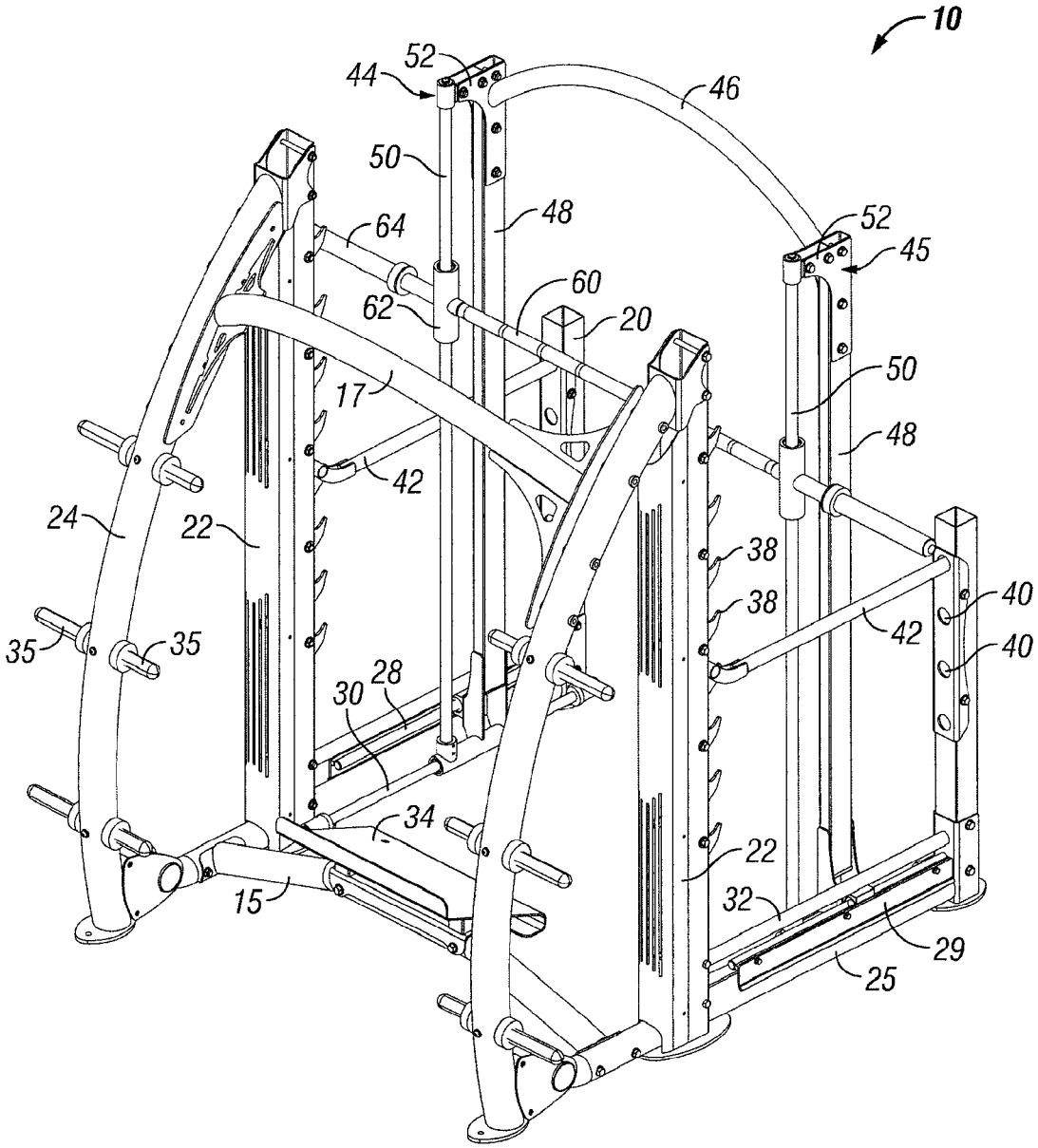
FIG. 2 is a rear perspective view of the machine of FIG. 1.
Figure 3:
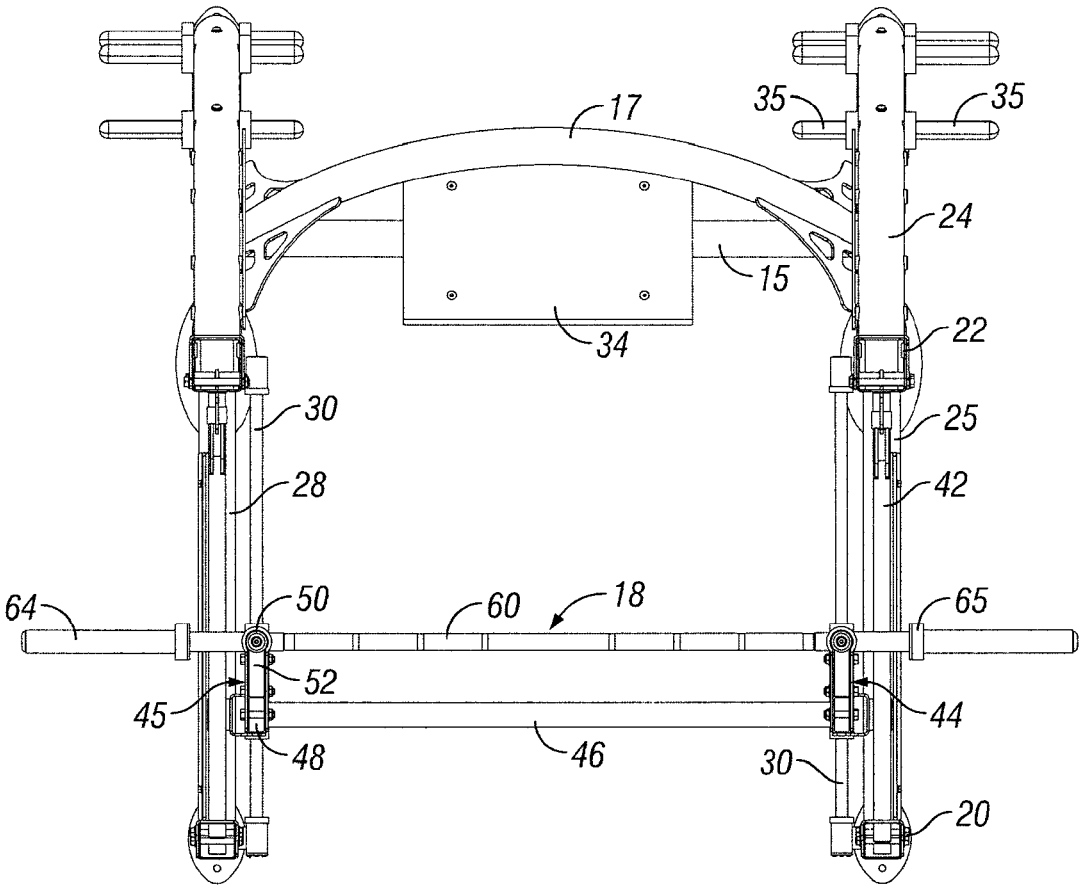
FIG. 3 is a top plan view of the machine of FIGS. 1 and 2.

A series of oppositely directed weight storage pegs 35 are provided at spaced locations on each of the curved rear supports 24. A toothed plate 36 having a series of vertically spaced teeth 38 is secured on the inner face of each second upright 22. The shorter, first uprights 20 each have a series of spaced holes 40 (see FIG. 2) which face the respective second uprights 22. An adjustable safety stop bar 42 spans the distance between the two vertical uprights 20, 22 on each side of the frame, with one end engaging a selected one of the holes 40 and the second end engaging an aligned hook 38 on the respective opposing second upright 22, as illustrated in FIGS. 1 and 2.

Figure 7:
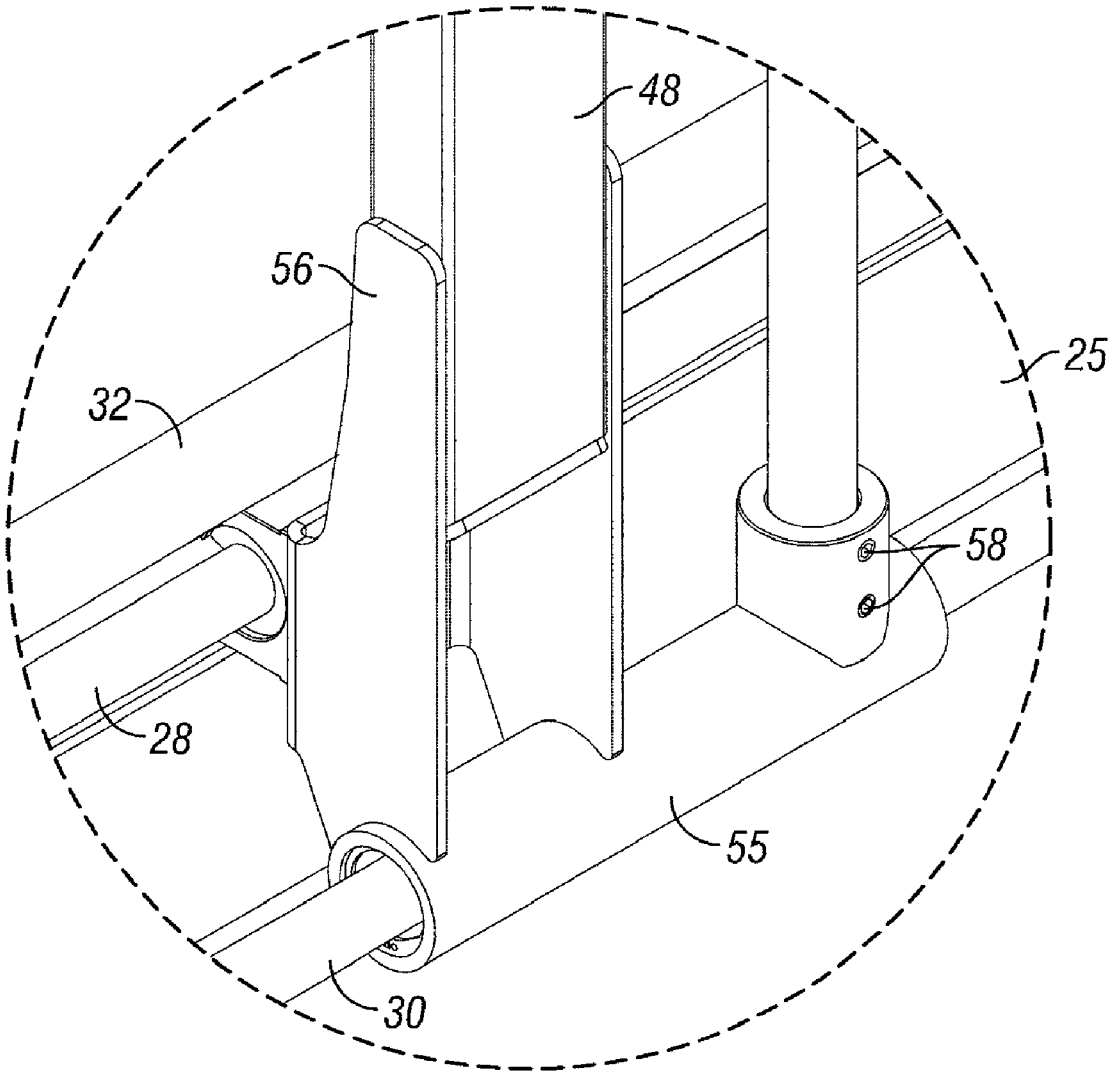
FIG. 7 is an enlarged view of the circled area in FIG. 1, illustrating the horizontal slides engaging the horizontal guides on one side of the frame.
Figure 8:
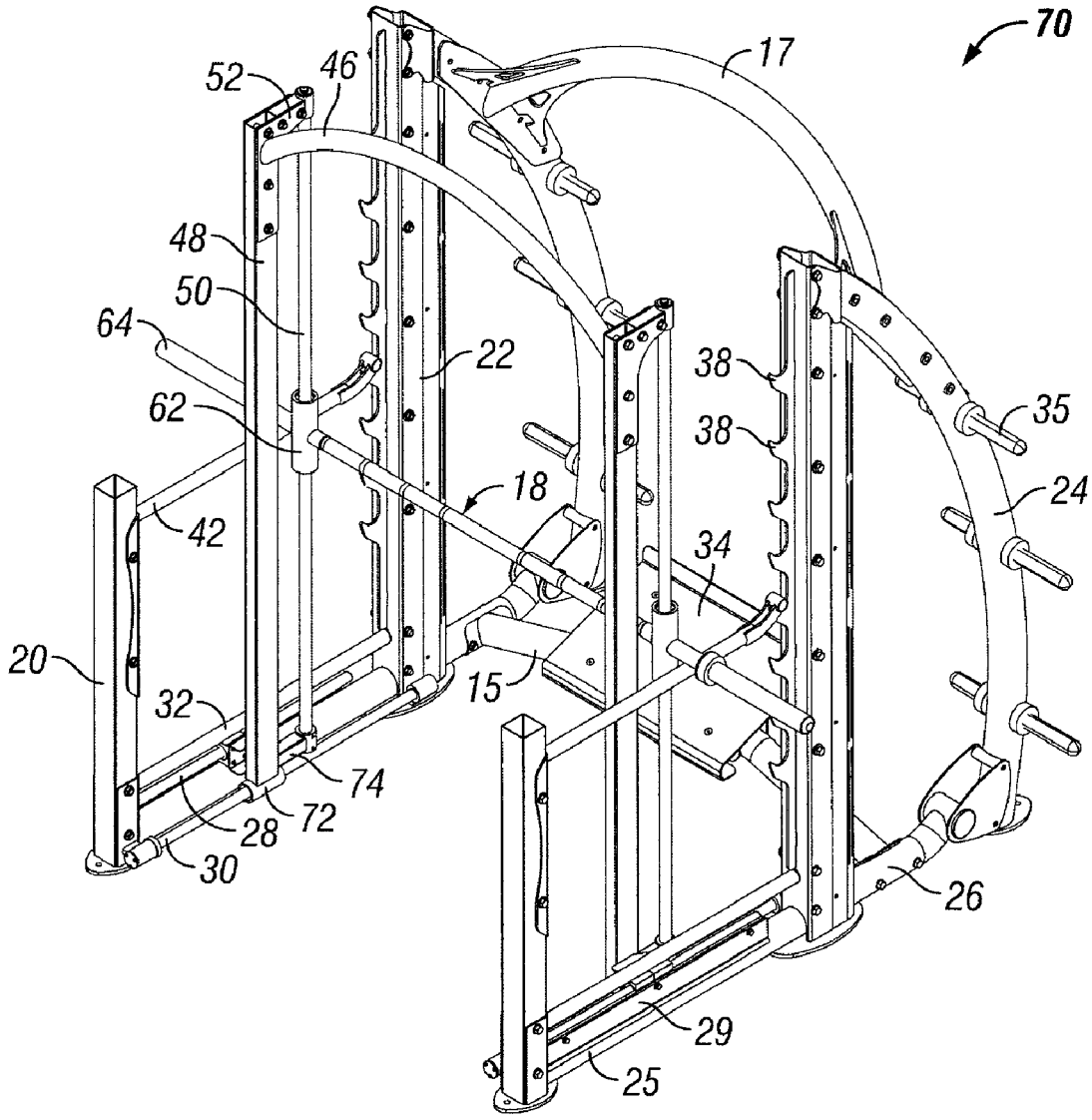
FIG. 8 is a front perspective view of a dual action weightlifting machine according to a second embodiment.

The traveling frame 16 comprises left and right vertical side portions or uprights 44, 45 positioned inboard of the left and right side frame, and connected together by a single upper cross support 46. Each vertical upright comprises a vertical strut 48 and a vertical guide 50 extending parallel to the vertical strut and secured to the vertical strut by a cross piece or bracket 52 at the upper end of strut 48. Each vertical upright of the traveling frame is secured at its lower end to the first and second horizontal slides 54, 55 of the horizontal slide assembly, which are slidably engaged on the first and second horizontal guides 28, 30, respectively. As illustrated in FIG. 7, the lower end of the vertical strut 48 is secured to the first horizontal slide 54 and second horizontal slide 55 via bracket 56. The lower end of vertical guide 50 is rigidly attached to the second horizontal slide 55 by screws 58 or other suitable fasteners. In this embodiment, the first or upper slide 54 is a single, open style or C-shaped linear bearing, while the second or lower slide 55 contains two closed style or O-shaped linear bearings, although other types of slides such as open or closed bearing, rollers, or the like may be used in alternative embodiments. The dual, low position slides engaging corresponding dual guides on each side of the frame provide added rigidity. In this embodiment, there are no overhead sliding or alignment components on the traveling frame, just a single upper cross bar or support 46. This reduces the weight of the traveling frame and lessens the inertia required to initiate or change direction on the horizontal plane when carrying out weightlifting exercises on this machine.

The exercise bar assembly 18 comprises a user engaging portion 60, first and second vertical slides 62 which slidably engage the respective vertical guides 50 on opposite sides of the frame, and first and second weight receiving pegs 64 which project outwardly from the respective first and second vertical slides 62 for receiving weights. In the exercise position of FIGS. 1, 2 and 5, the exercise bar assembly can slide freely up and down on the vertical guides 50 until it reaches the lowermost position defined by the adjustable safety stop bars 42. FIG. 6 illustrates the exercise bar assembly in a storage or rest position in which a portion of each weight receiving peg engages directly in one of the hooks 38 on the respective second uprights 22, without any secondary hooks, latches, or catch mechanisms. As illustrated in FIGS. 1 and 2, an annular flange 65 may be provided between the portion of each peg which engages a hook in the rest or storage position, and the end portion of each peg which receives one or more weights. The user may match the starting position of the bar based on their height, the type of exercise to be performed, or both, by selecting the height of the hooks 38 in which the bar is engaged prior to starting exercise. The exercise bar assembly may include a freely rotatable user engaging portion, for example as described in co-pending application Ser. No.

11/929,372 filed Oct. 30, 2007, the contents of which are incorporated herein by reference.

In order to perform a weightlifting exercise such as a squat, press, or lunge using the machine 10 of FIGS. 1 to 7, the user enters from the front of the machine and stands between the side frames. The exercise bar assembly can be set to the desired starting height, as noted above, and the adjustable safety stop bars 42 are also moved to the desired position dependent on the type of exercise to be performed. The user then engages the user engaging portion 60 of the exercise bar, lifts the bar from the hooks 38, and can then perform simultaneous or combined horizontal and vertical movements depending on the selected exercise type. The traveling frame 16 slides on the lower guides 28 and 30 to accommodate desired horizontal movement, while the exercise bar assembly 18 slides up and down on vertical guides 50 to accommodate vertical movement. The machine of this embodiment allows a large number of different weightlifting exercises to be performed without the limitations of corresponding free weight exercises. The low position, dual horizontal guide system keeps moving parts out of the way of the exercise movement and eliminates overhead sliding guide systems and framework. The traveling frame is relatively lightweight so that it is easier for the user to initiate or changed direction in the horizontal direction.

Figure 12:
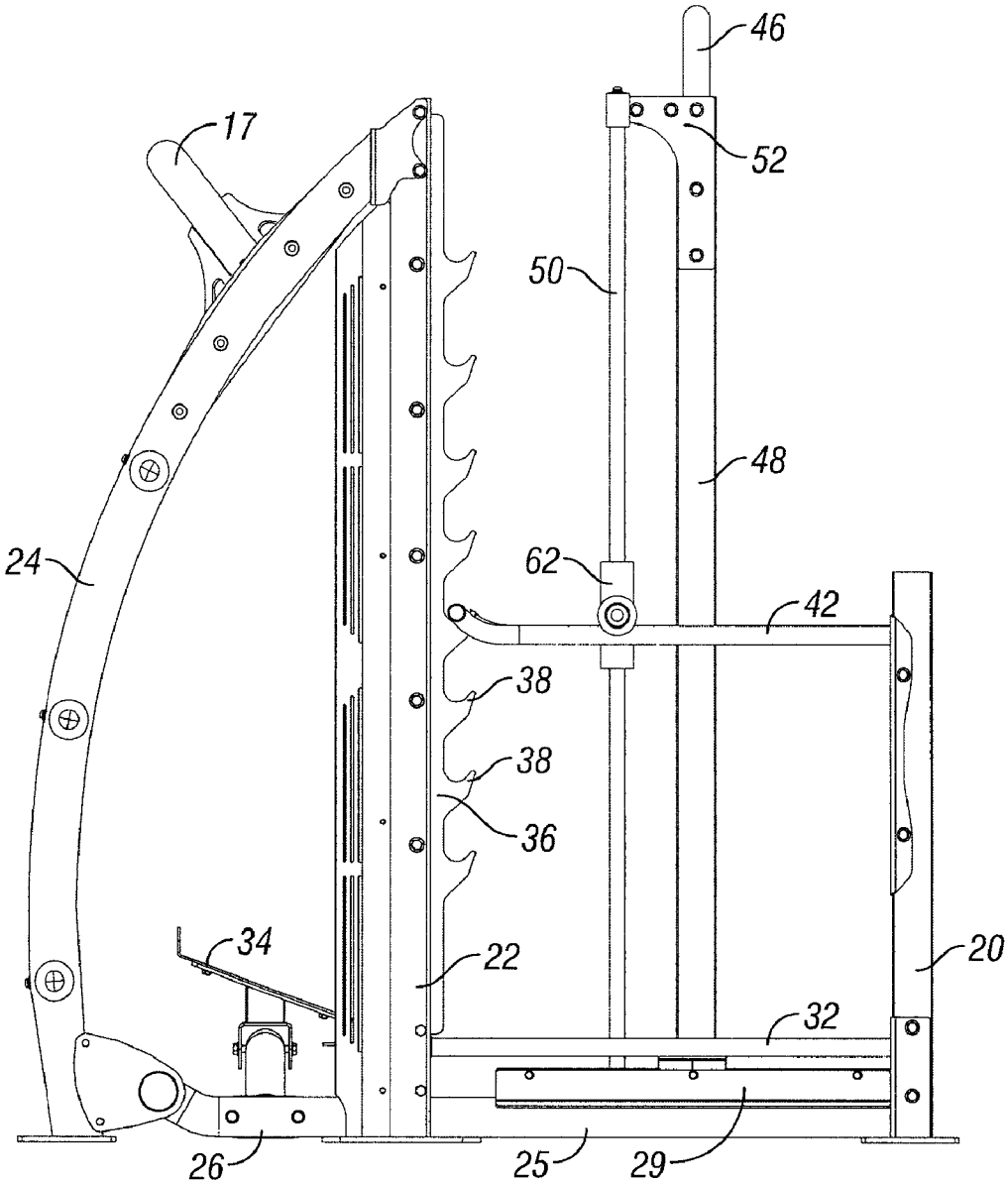
FIG. 12 is a side elevation view of the machine of FIGS. 8 to 11 with the movable frame positioned away from the vertical uprights and the exercise bar resting on top of the adjustable safety stop bar.
Figure 13:
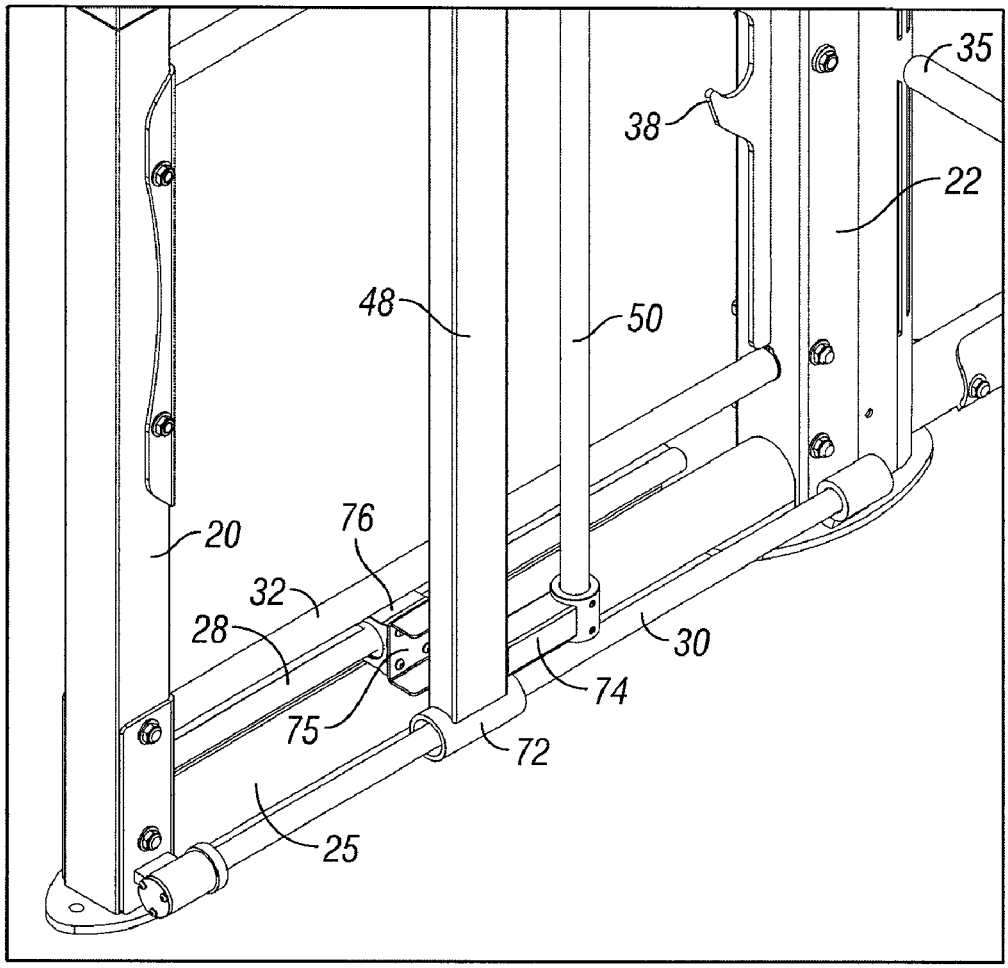
FIG. 13 is an enlarged view of the inside, lower part of one side frame illustrating the horizontal slides of the traveling frame engaging the horizontal guides.
Figure 14:
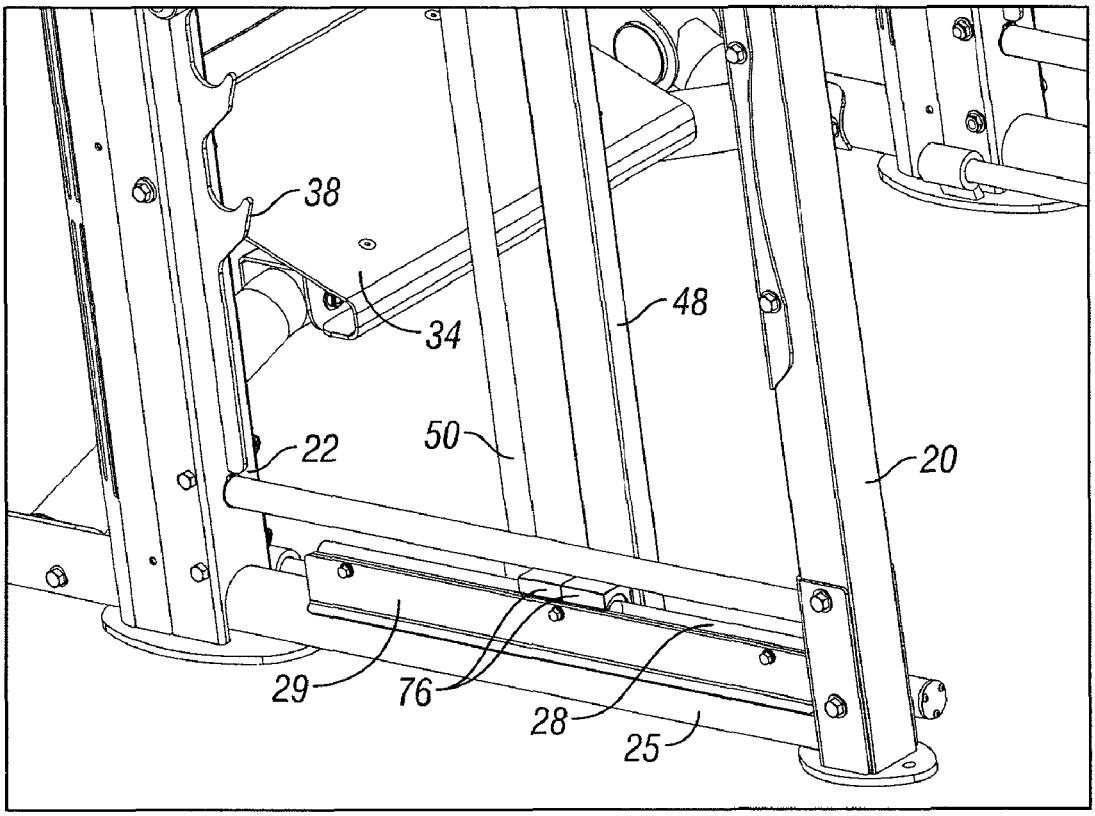
FIG. 14 is an enlarged view similar to FIG. 13 but illustrating the outside of the side frame.
Figure 15:
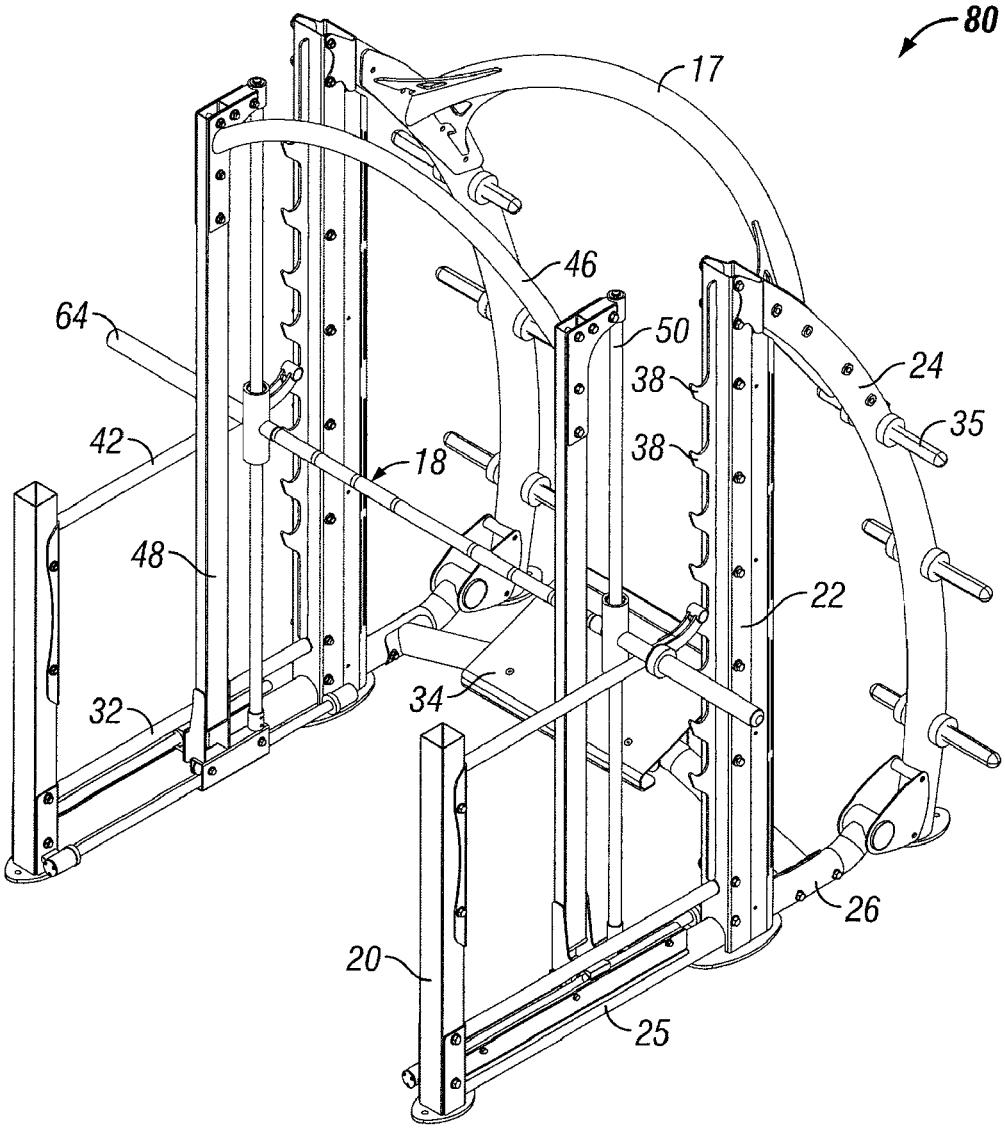
FIG. 15 is a front perspective view of a dual action weightlifting machine according to a third embodiment.

FIGS. 8 to 14 illustrate a modified dual action weightlifting machine 70 according to a second embodiment. The weightlifting machine 70 is identical in many respects to the weightlifting machine 10 of the first embodiment, and like reference numbers have been used for like parts as appropriate. However, in this embodiment, the horizontal slide assembly between the traveling frame and the stationary main frame is different, as best illustrated in FIGS. 13 and 14.

In this embodiment, the first and second horizontal guides 28 and 30 are mounted on the lower end of the main frame in the same manner as the first embodiment, but the lower end of each vertical strut 48 mounts to the respective second or lower horizontal guide 30 via horizontal slide 72, as seen in FIG. 13, eliminating bracket 56. The lower end of vertical guide 50 is secured to the vertical strut 48 via a stand-off 74, rather than connecting directly to the second horizontal slide as in the previous embodiment. The lower end of vertical strut 48 is also attached by a connecting bracket 75 to horizontal slide 76 which is slidably engaged with the first or upper horizontal guide 28. In this embodiment, the upper horizontal slide 76 comprises two, open style or C-shaped linear bearings while the lower horizontal slide 72 contains a single, closed style or O-shaped linear bearing.

Figure 9:
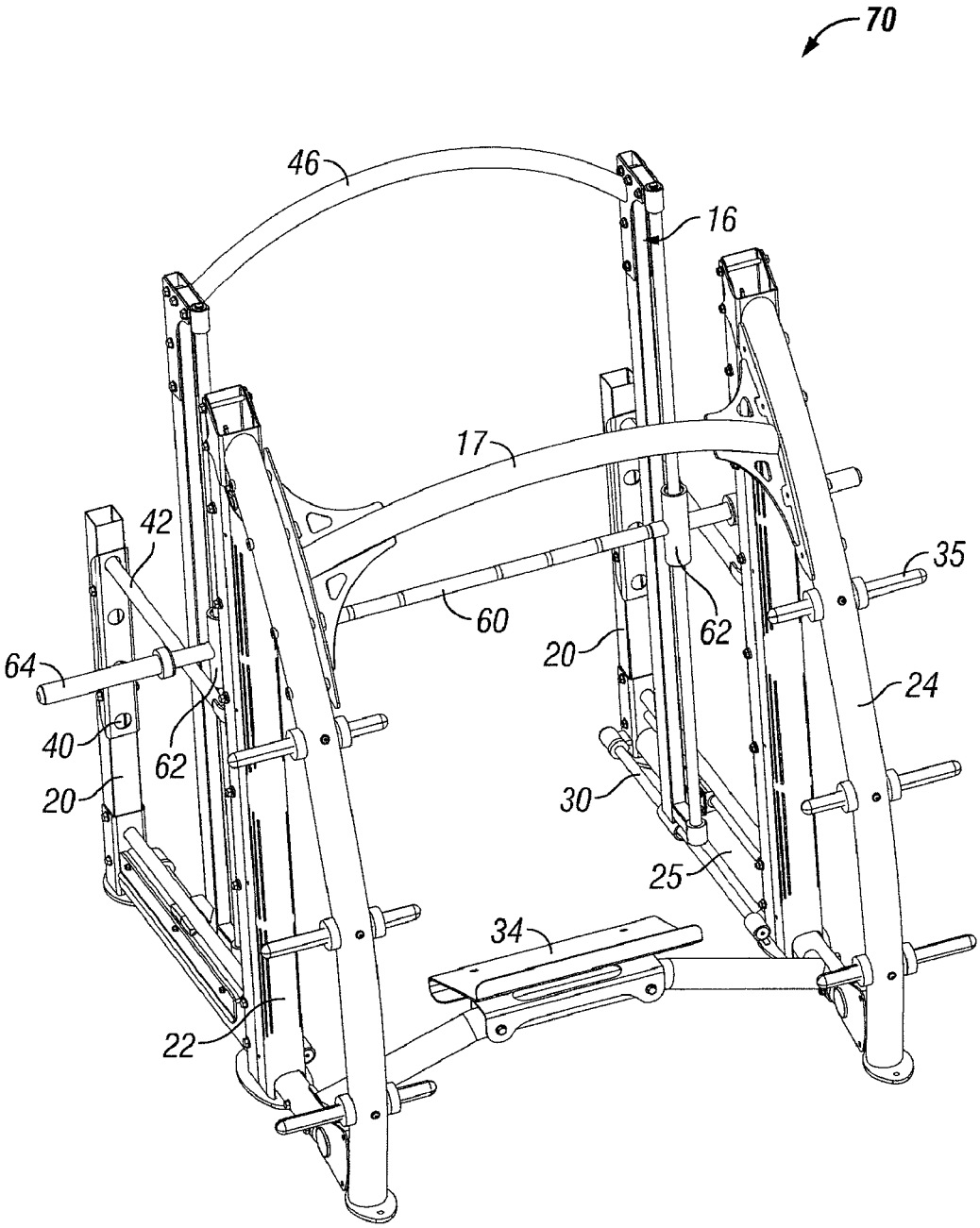
FIG. 9 is a rear perspective view of the machine of FIG. 8.
Figure 10:
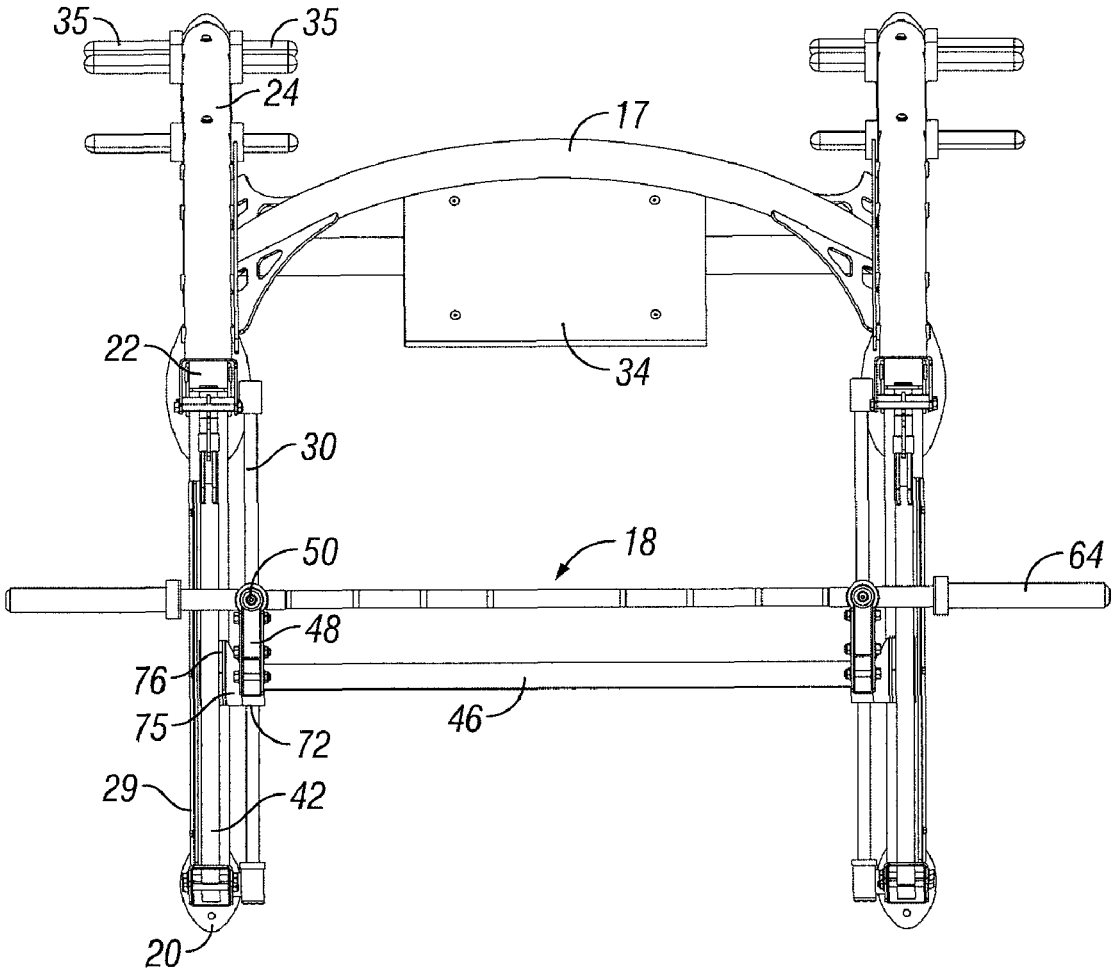
FIG. 10 is a top plan view of the machine of FIGS. 8 and 9.
Figure 11:
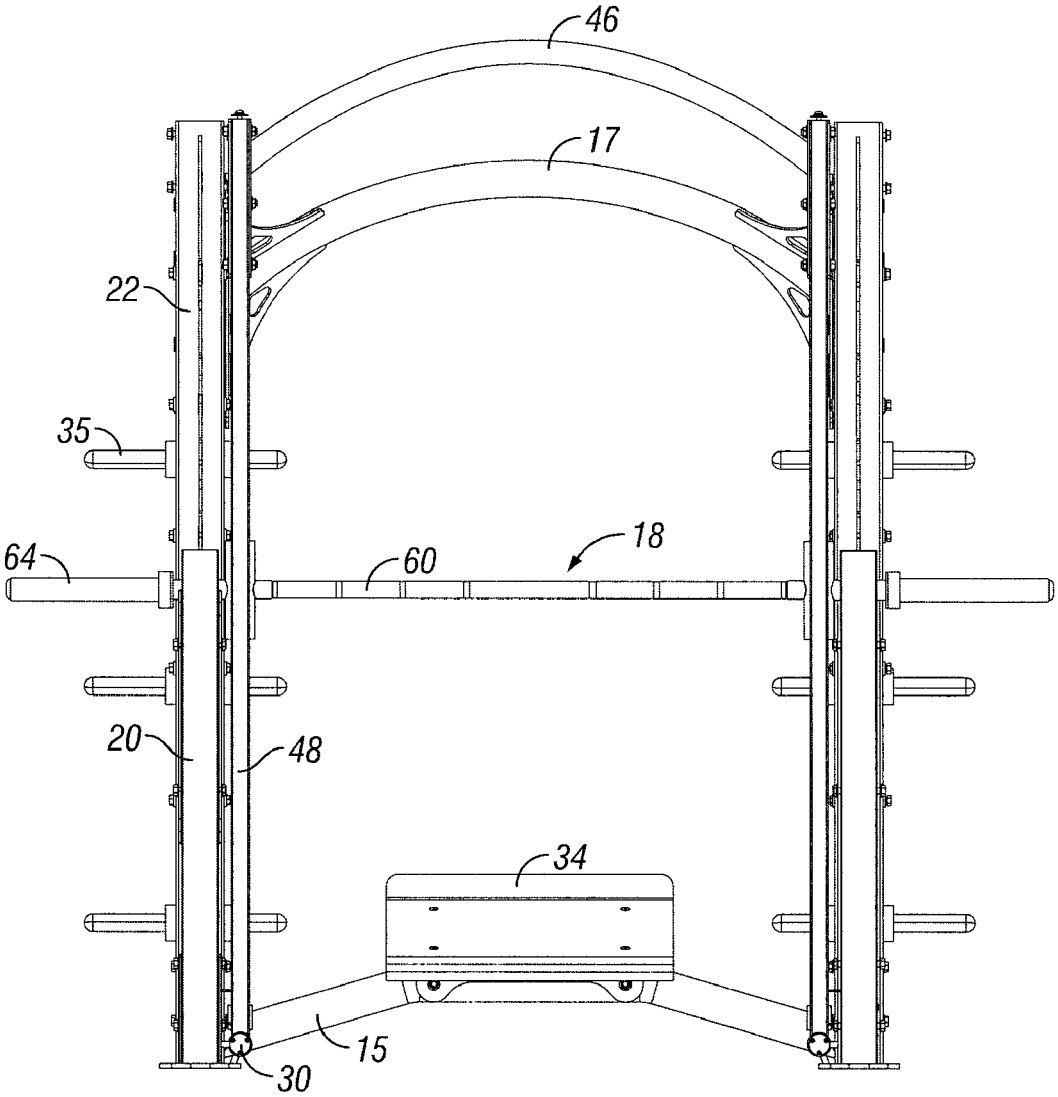
FIG. 11 is a front elevation view of the machine of FIGS. 8 to 10.

In FIGS. 9 and 12, the traveling frame 16 is illustrated in an exercise position away from the vertical uprights 22 and with the exercise bar 18 resting on top of the adjustable safety stop bars 42, which in this case define the lowermost position of the exercise bar. The safety stop bars 42 may be positioned at a lower elevation than in FIGS. 9 and 12 in alternative embodiments, using the different adjustment holes 40 as in the previous embodiment. Exercises are performed on the modified machine 70 of FIGS. 8 to 14 in the same way as in the first embodiment.

FIGS. 15 to 18 illustrate a modified dual action weightlifting machine 80 in which the only difference from the first and second embodiment is the slightly different lower horizontal slide assembly. All other elements in FIGS. 15 to 18 are the same as in the first embodiment of FIGS. 1 to 7, and like reference numbers have been used for like parts as appropriate.

Figure 16:
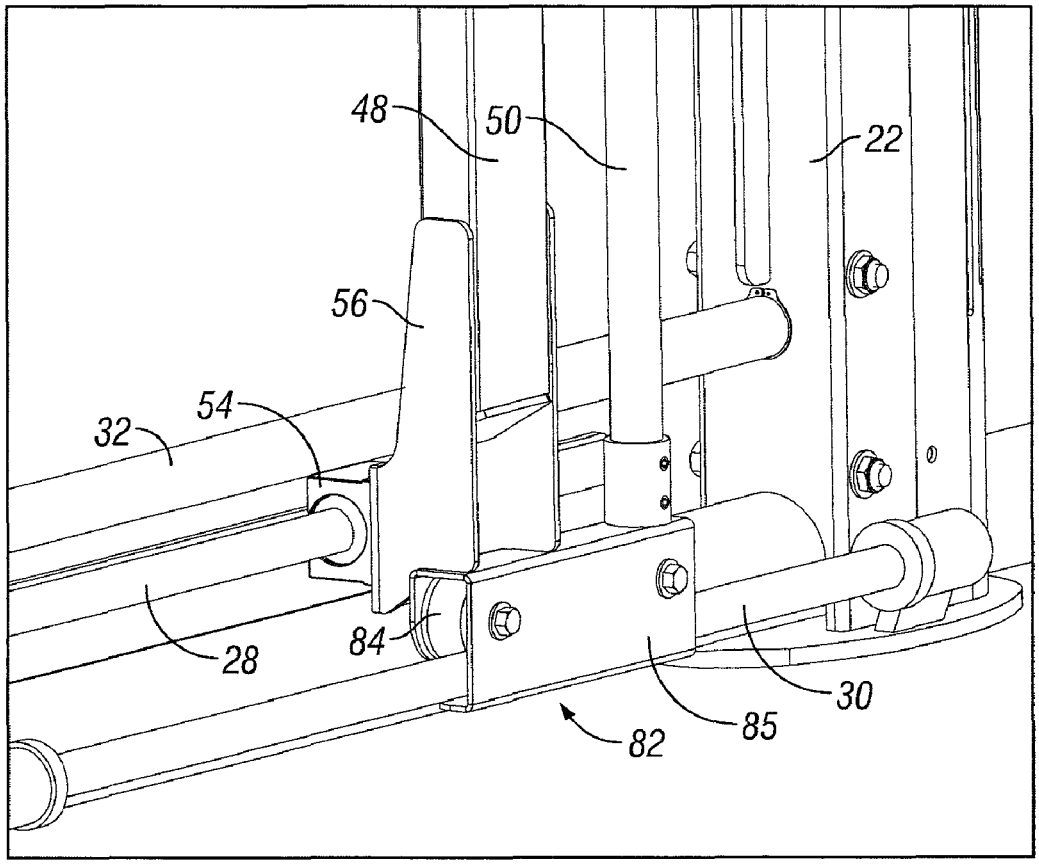
FIG. 16 is an enlarged, perspective view of the inside, lower part of one side frame and the traveling frame of the machine of FIG. 15, illustrating the horizontal slides of the traveling frame engaging the horizontal guides.
Figure 17:
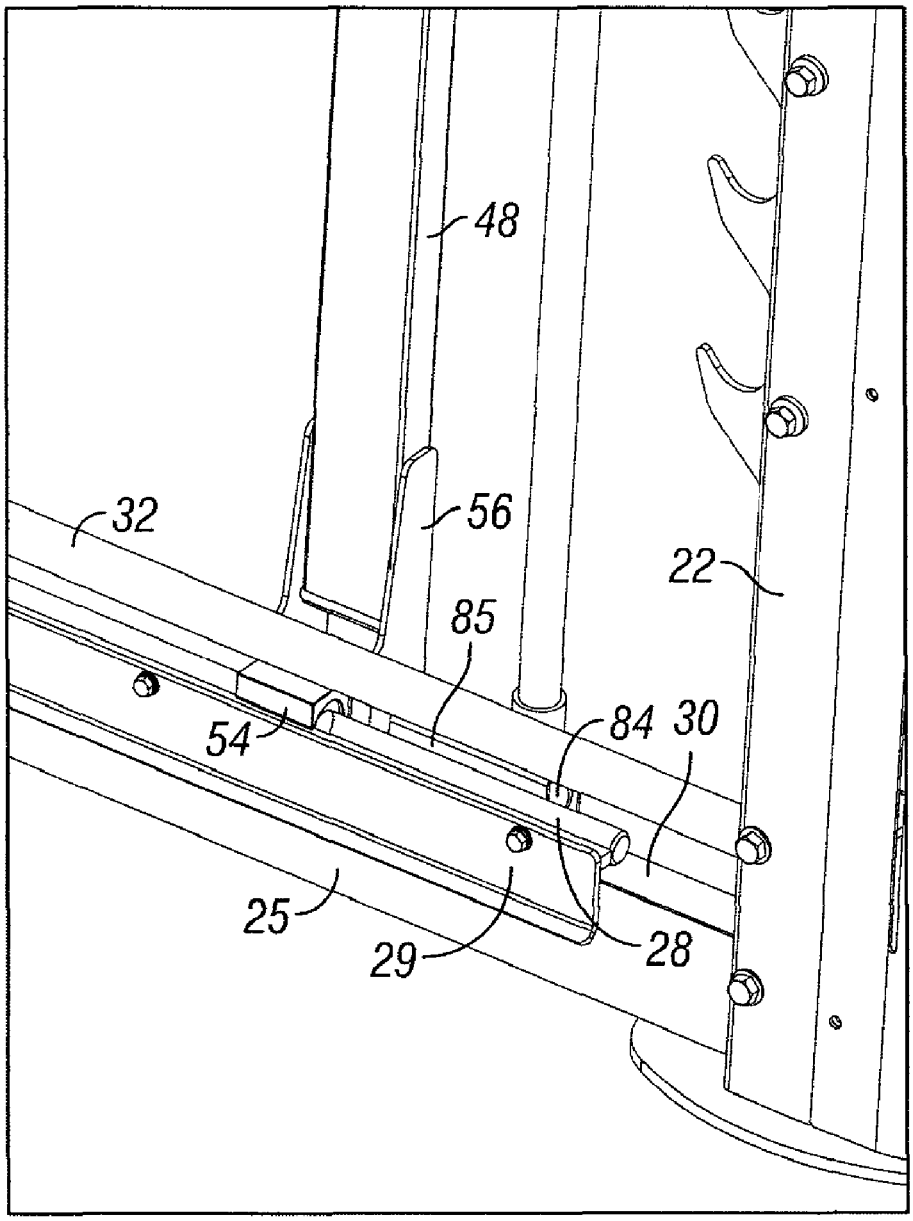
FIG. 17 is an enlarged view similar to FIG. 16 but illustrating the outside of the side frame.
Figure 18:
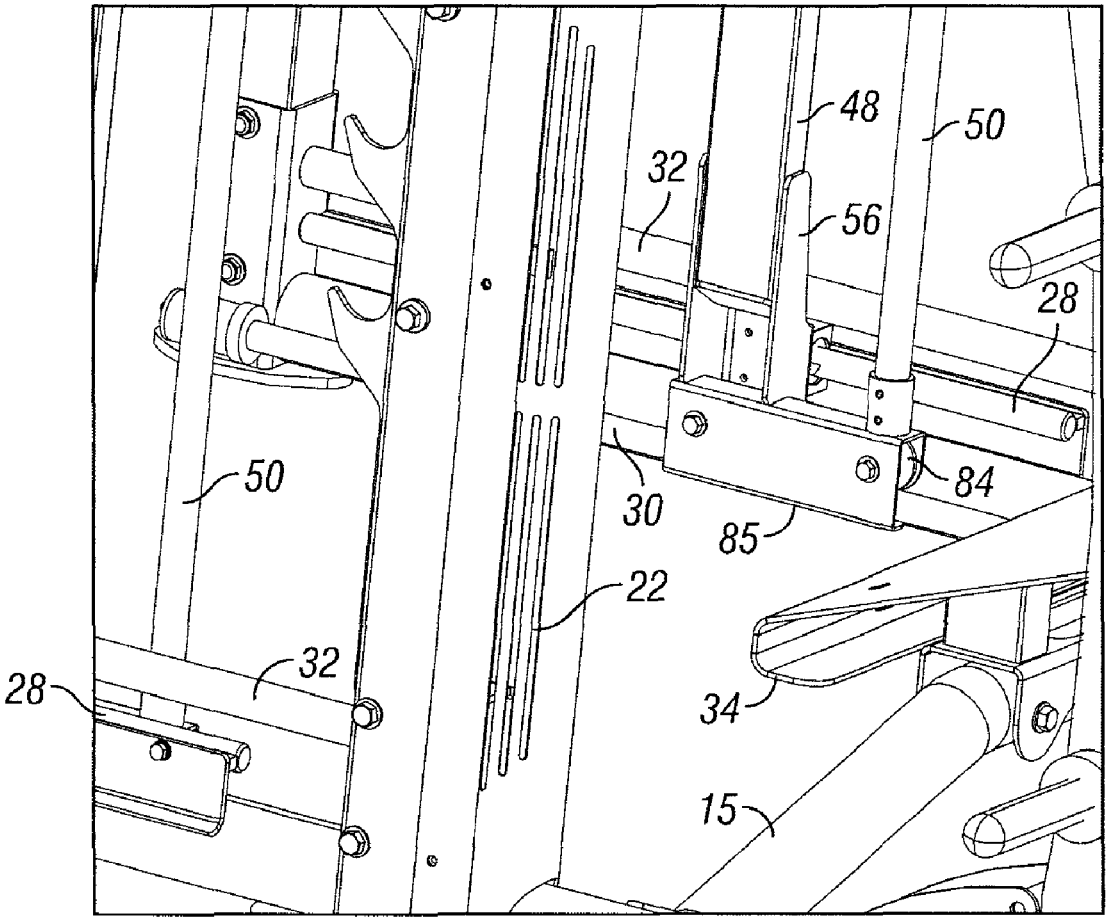
FIG. 18 is an enlarged, perspective view of the inside lower part of one side frame similar to FIG. 16 but taken from the opposite direction.
Figure 19:
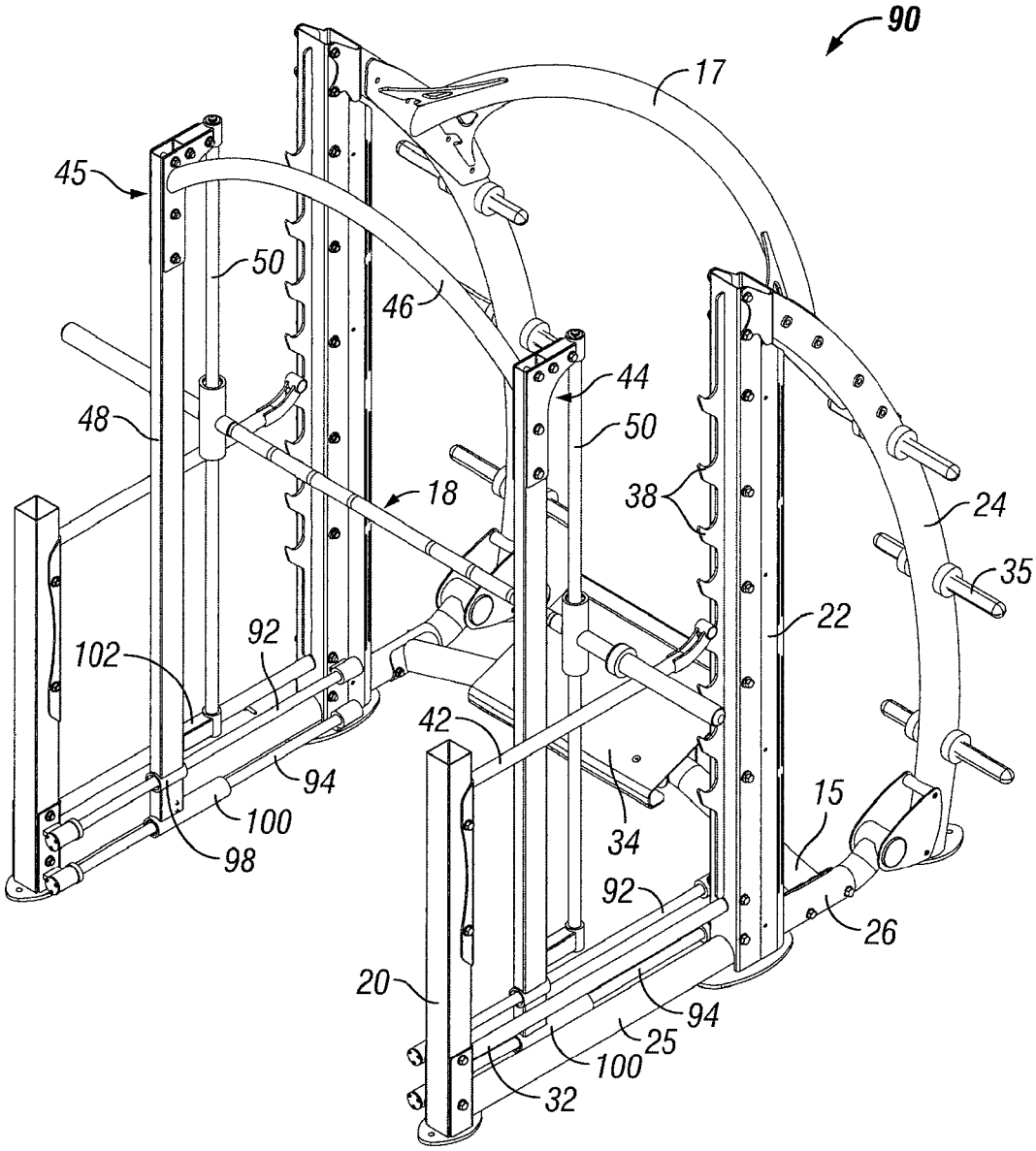
FIG. 19 is a front perspective view of a dual action weightlifting machine according to a fourth embodiment.
Figure 20:
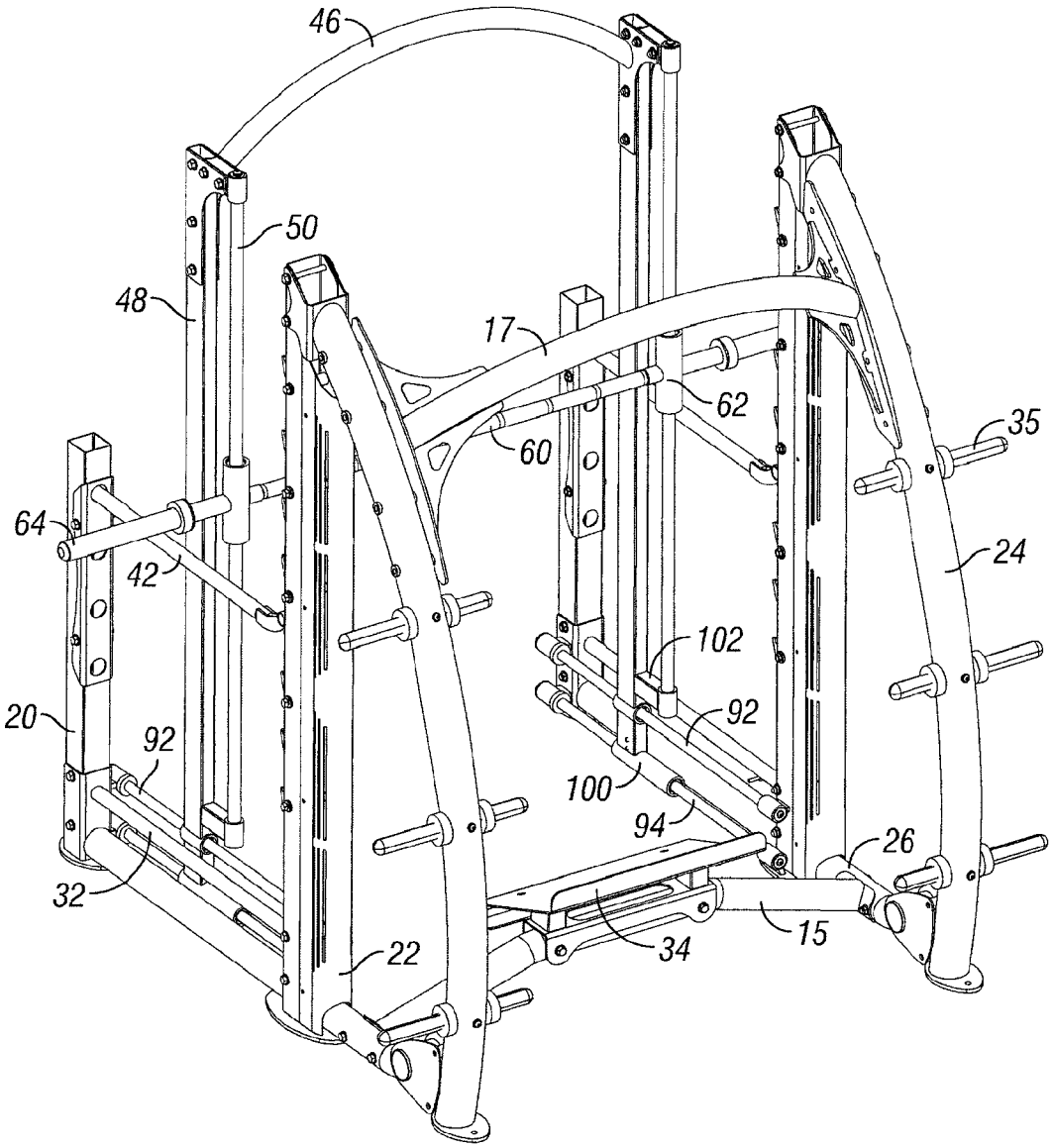
FIG. 20 is a rear perspective view of the machine of FIG. 19.
Figure 21:
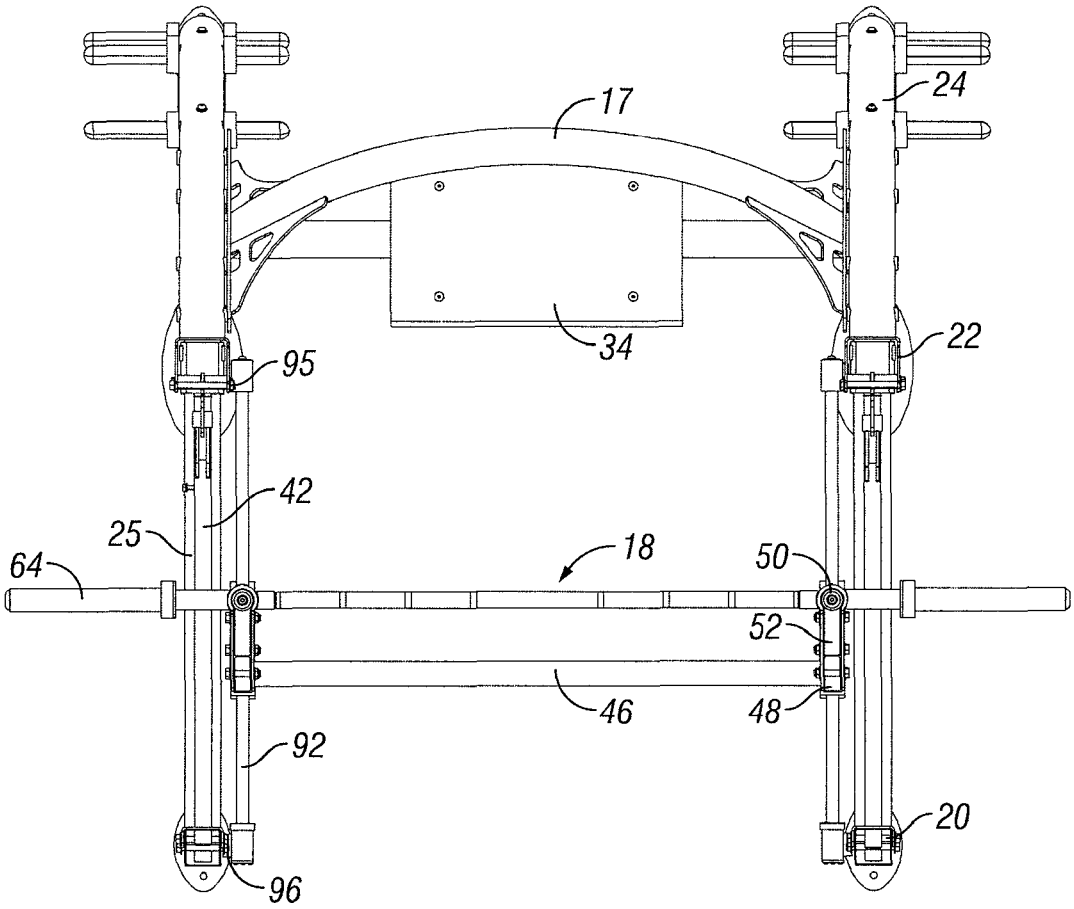
FIG. 21 is a top plan view of the machine of FIGS. 19 and 20.

FIGS. 16 to 18 are enlarged views illustrating the modified horizontal sliding assembly of this embodiment in more detail. In this embodiment, the second or lower horizontal slides 82 which are slidably engaged on the second horizontal guide 30 comprise two roller wheels 84 rotatably mounted in an outer housing 85, instead of closed linear bearings as in the first embodiment. As in the first embodiment, the lower end of the upright strut 48 is connected to both the second horizontal slide 82 and the first horizontal slide 54 by a connecting bracket 56. The lower end of the vertical guide 50 is rigidly connected to the outer housing 85 of the second horizontal slide 82, as best illustrated in FIG. 16. The first horizontal slides in this embodiment are single open bearings, as in the first embodiment.

FIGS. 19 to 25 illustrate a dual action weightlifting machine or Smith machine 90 according to another embodiment. This embodiment also has a modified lower horizontal sliding assembly, while other components of the machine are the same as in the first embodiment, and like reference numbers have been used for like parts as appropriate.

Figure 22:
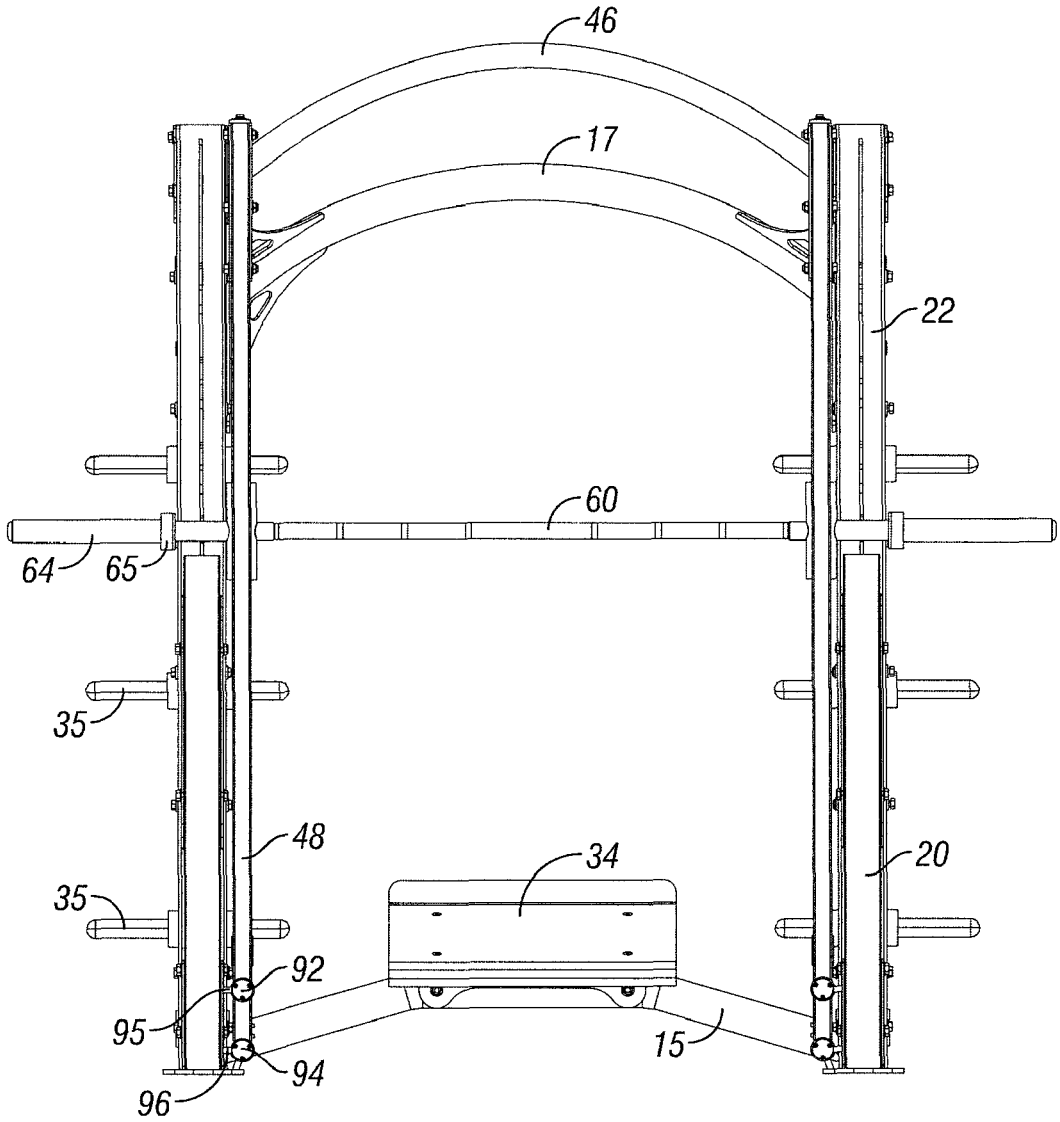
FIG. 22 is a front elevation view of the machine of FIGS. 19 to 21.
Figure 23:
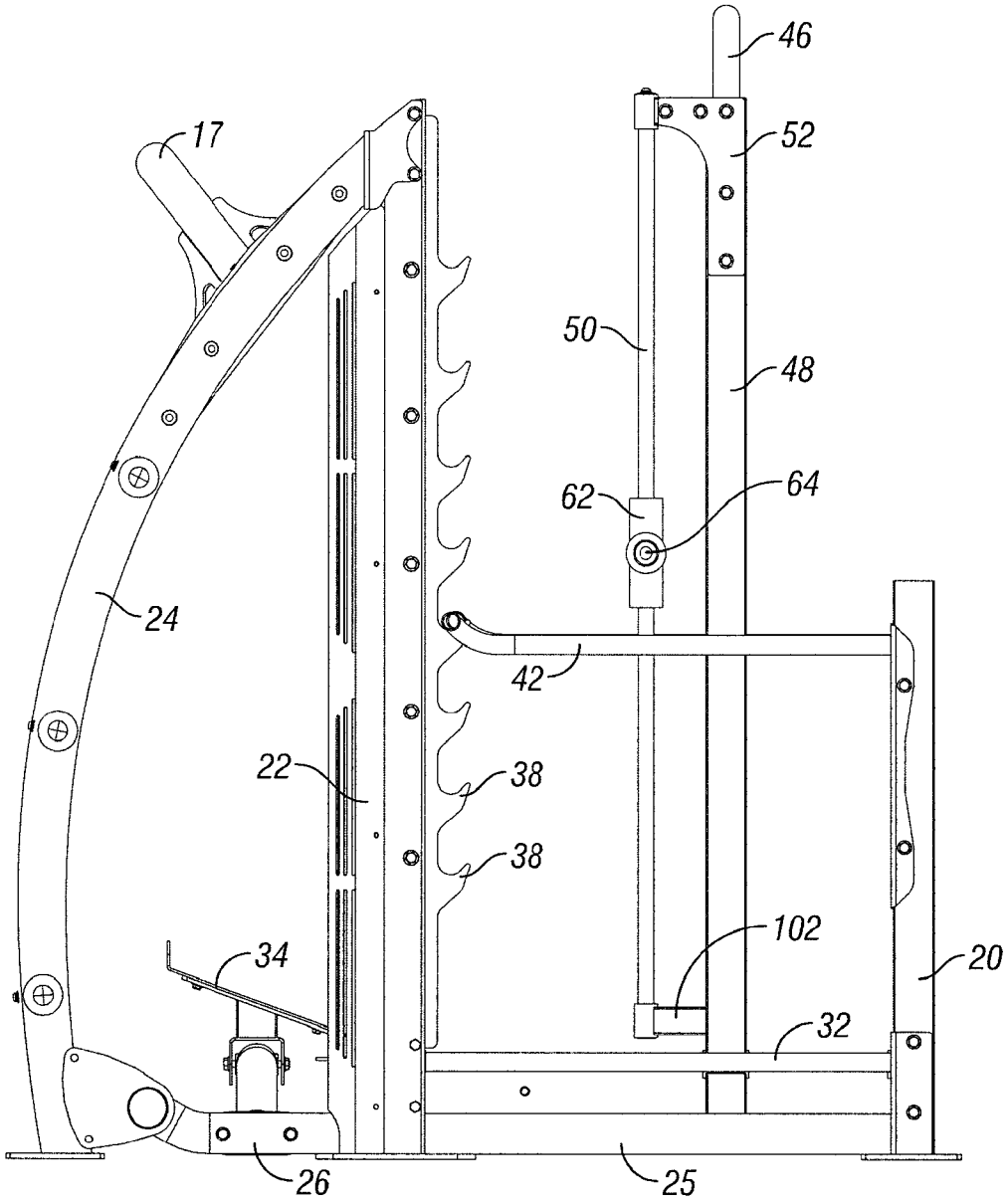
FIG. 23 is a side elevation view of the machine of FIGS. 19 to 22 with the movable frame positioned away from the vertical uprights and the exercise bar in an exercise position.
Figure 24:
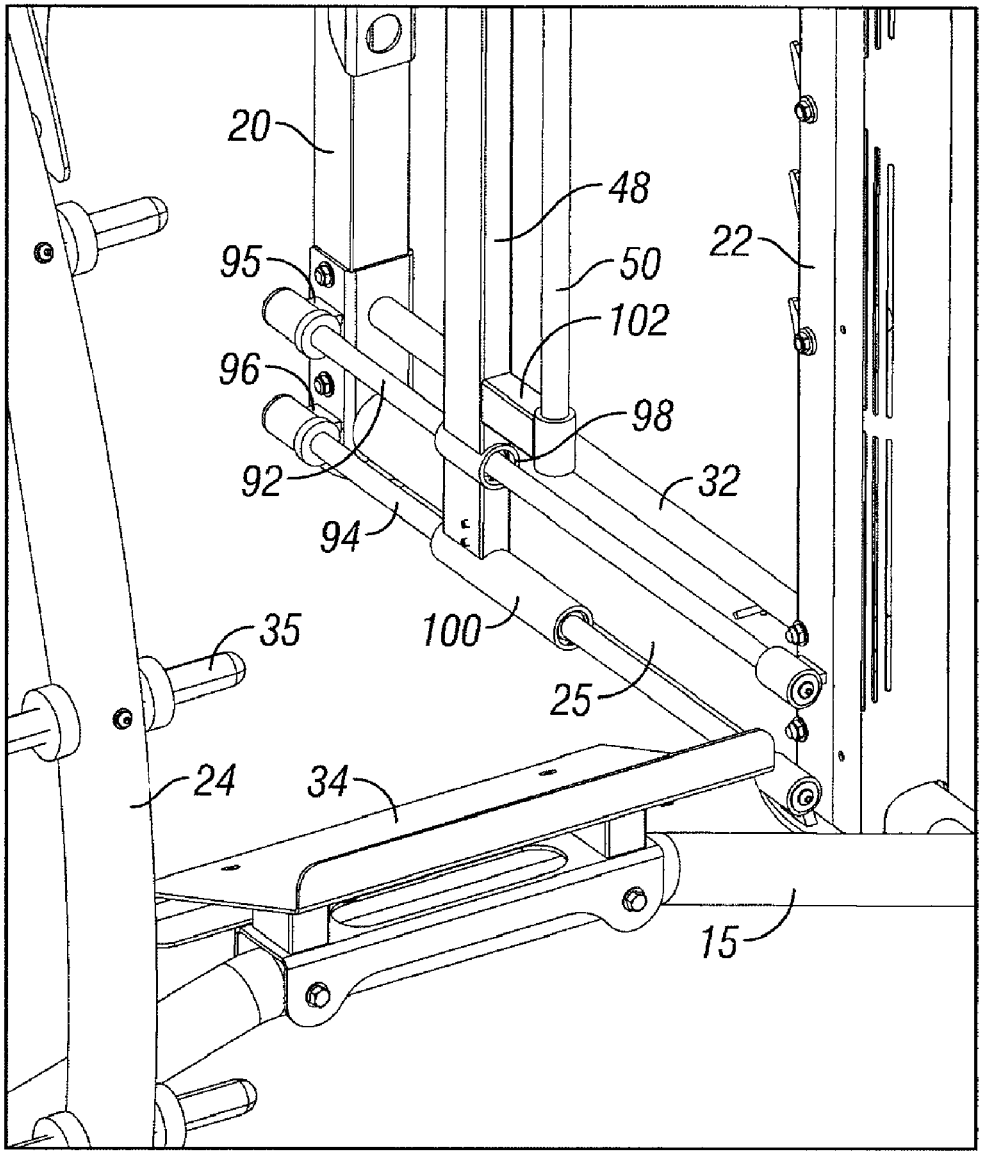
FIG. 24 is an enlarged, rear perspective view of the lower part of the machine, illustrating the horizontal slides on one side of the traveling frame engaging the horizontal guides.
Figure 25:
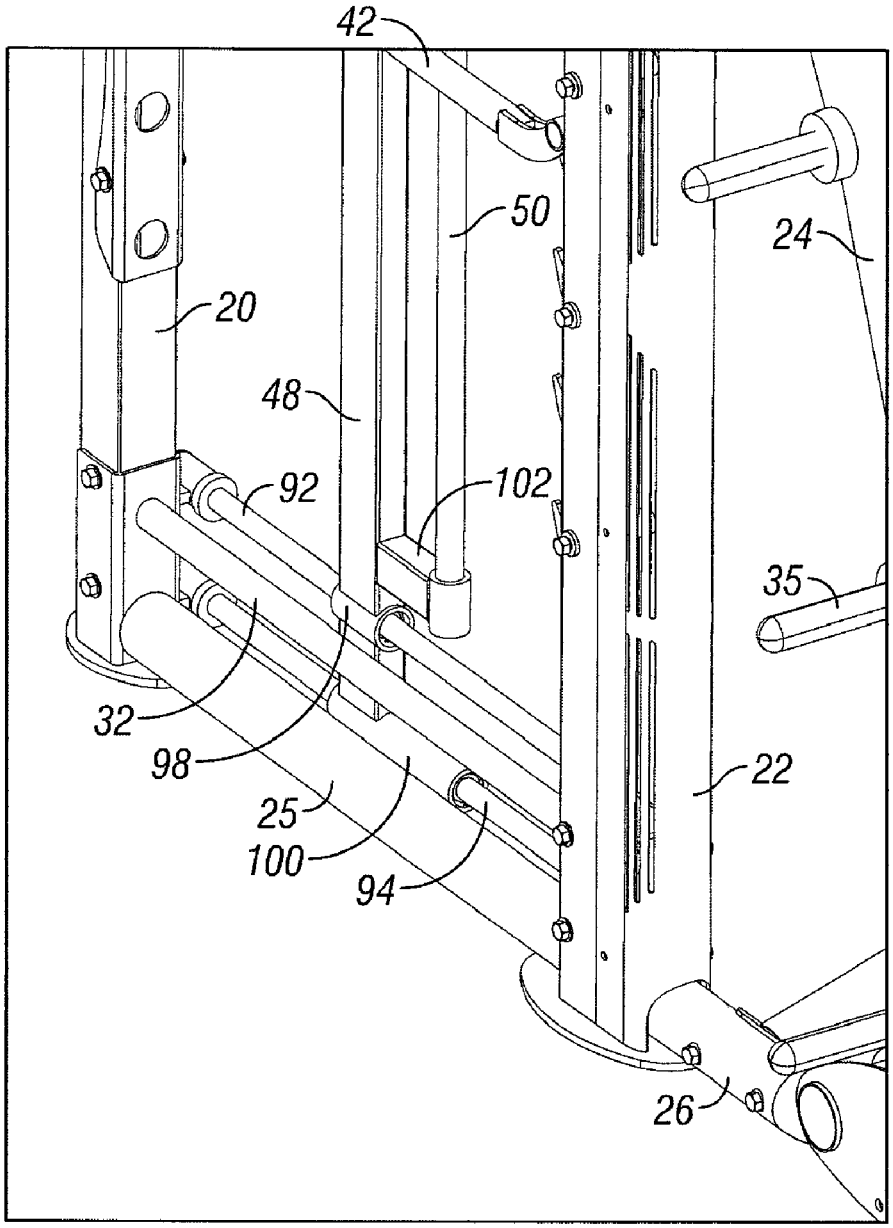
FIG. 25 is an enlarged view of the lower part of one side frame, taken from a position outside the frame.
Figure 26:
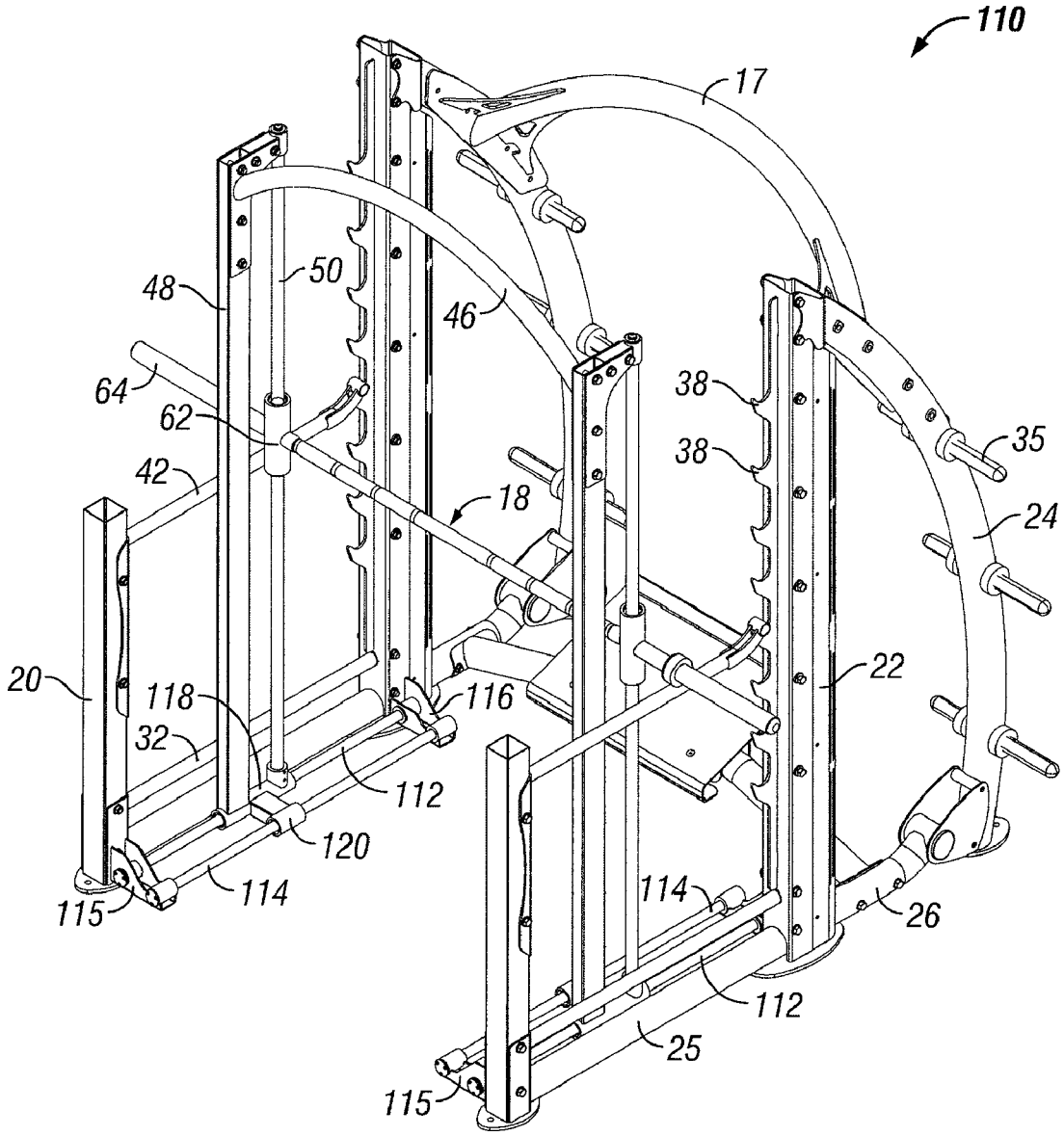
FIG. 26 is a front perspective view of a dual action weightlifting machine according to a fifth embodiment.
Figure 27:
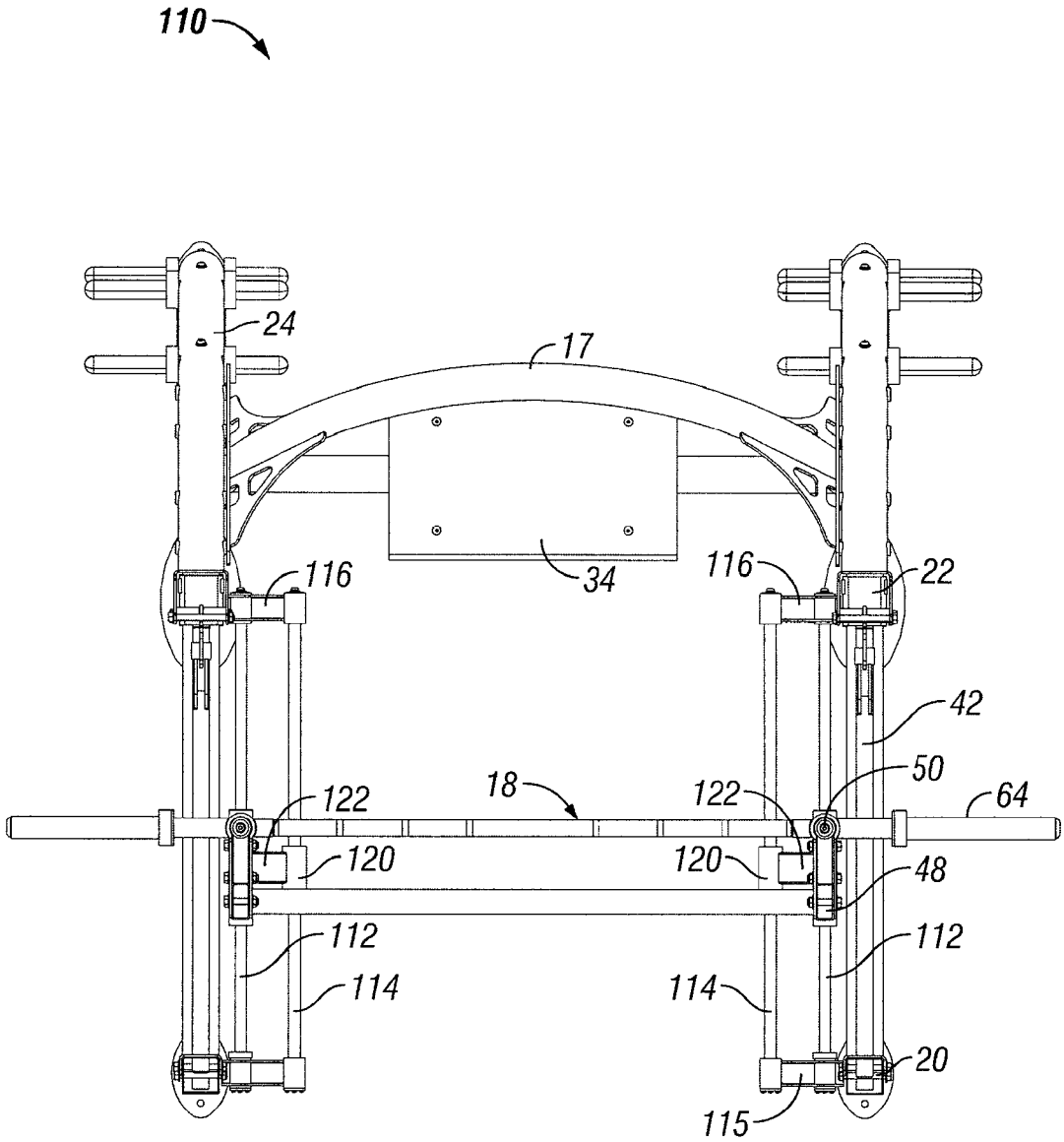
FIG. 27 is a top plan view of the machine of FIG. 26.
Figure 28:
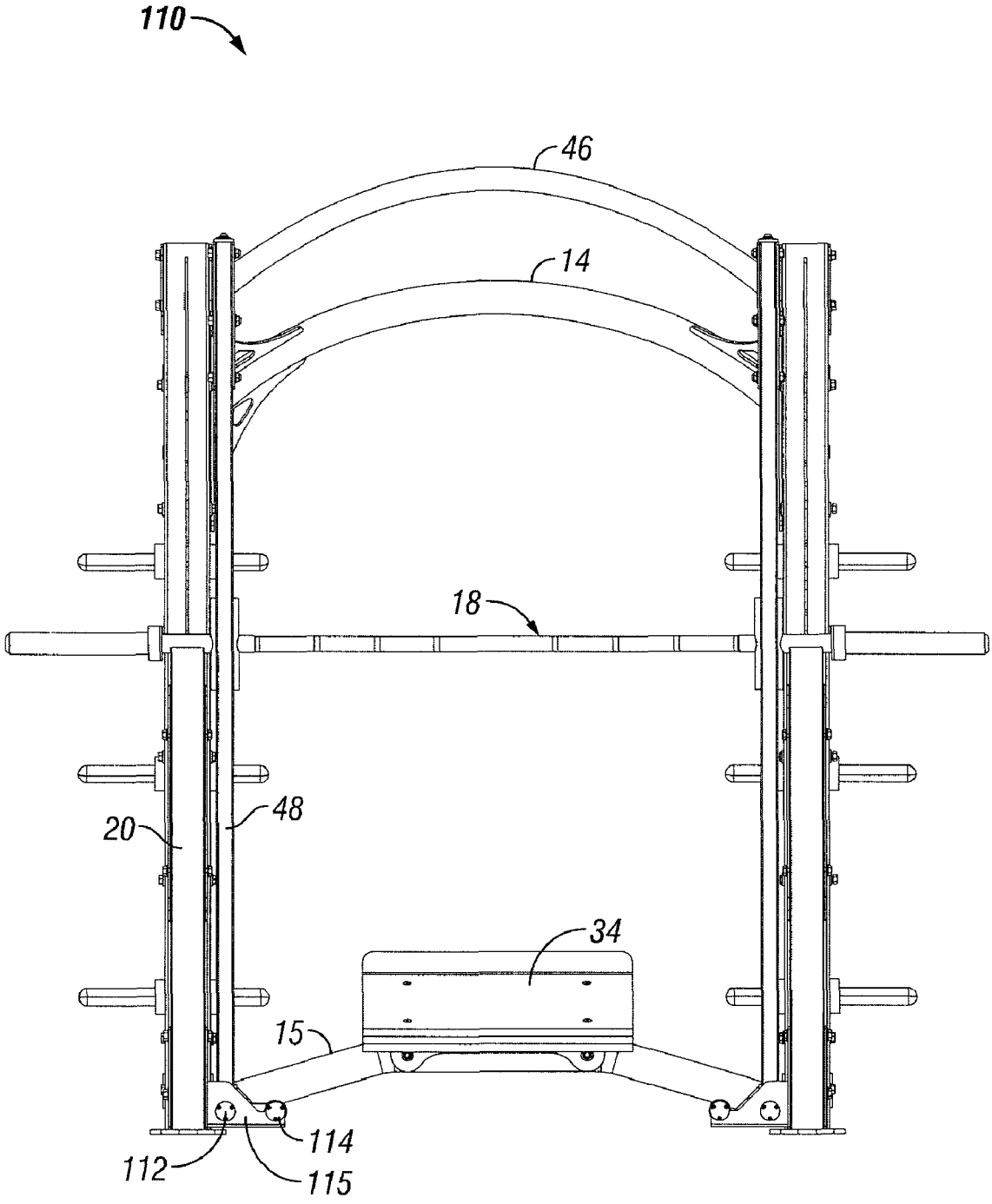
FIG. 28 is a front elevation view of the machine of FIGS. 26 and 27.
Figure 29:
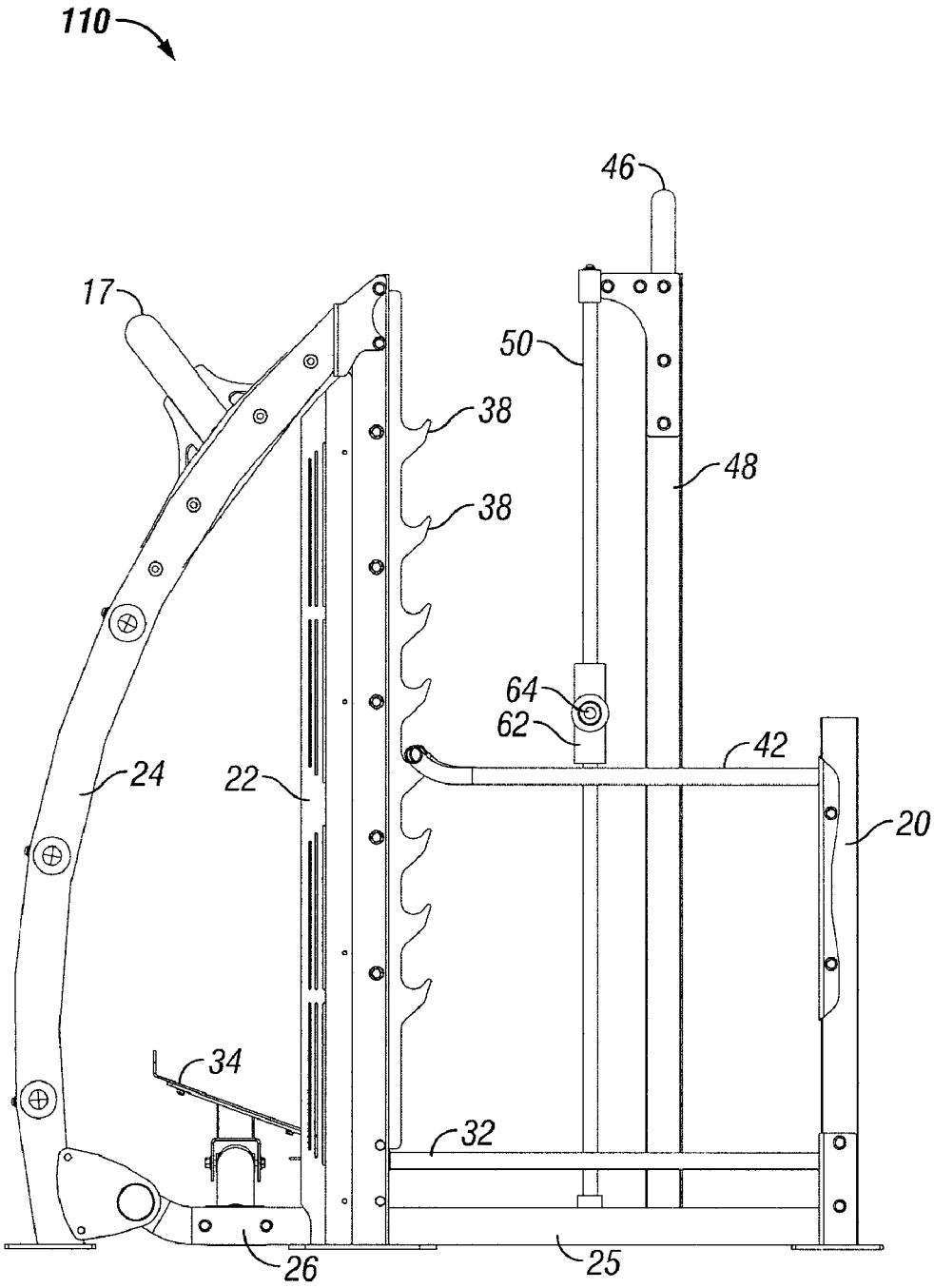
FIG. 29 is a side elevation view of the machine of FIGS. 26 to 28 with the movable frame positioned away from the vertical uprights.

In each of the previous embodiments, the two horizontal guides 28, 30 on each side of the frame were both horizontally and vertically offset, with the first horizontal guide positioned above the base tube 25 and the second horizontal guide offset both inwardly and downwardly from the first horizontal guide. In this embodiment, first and second vertically aligned horizontal guides 92, 94 are provided on each side of the stationary main frame. Each first or upper horizontal guide 92 is secured to the first and second uprights 20, 22 on the respective side of the frame by stand-offs 95, while each second or lower horizontal guide 94 is secured to the respective first and second uprights by similar stand-offs 96, as best illustrated in FIGS. 22 and 24. First and second horizontal slides 98, 100 are slidably engaged with the first and second horizontal guides 92, 94, respectively. As illustrated in FIG. 24, the first horizontal slide 98 extends transversely through the vertical strut 48 of the traveling frame at a location spaced above the lower end of the strut, while the second horizontal slide 100 is mounted at the lower end of the vertical strut. The lower end of the vertical guide 50 is secured to the vertical strut 48 via post or stand-off 102 at a location spaced above the first horizontal guide.

In this embodiment, the upper slide 98 contains one closed style linear bearing and the lower slide 100 contains two closed style linear bearings. Another difference is that the stationary safety stop or bar 32 is positioned at the same elevation as the first or upper horizontal guide 92. In this embodiment, the sleeve or end cap of stand-off 102 which is secured to the lower end of each vertical guide 50 (FIG. 24) acts as a stop which engages the lower ends of the vertical slides 62 to define a lowermost vertical position of the exercise bar. Operation of the machine of FIGS. 19 to 25 is otherwise substantially identical to operation of the machines of the previous embodiments.

FIGS. 26 to 31 illustrate a modified dual action or Smith machine 110 according to a fifth embodiment. Again, this machine has a modified horizontal slide assembly but is otherwise identical to the machines of the previous embodiments, and like reference numbers are used for like parts as appropriate.

Figure 30:
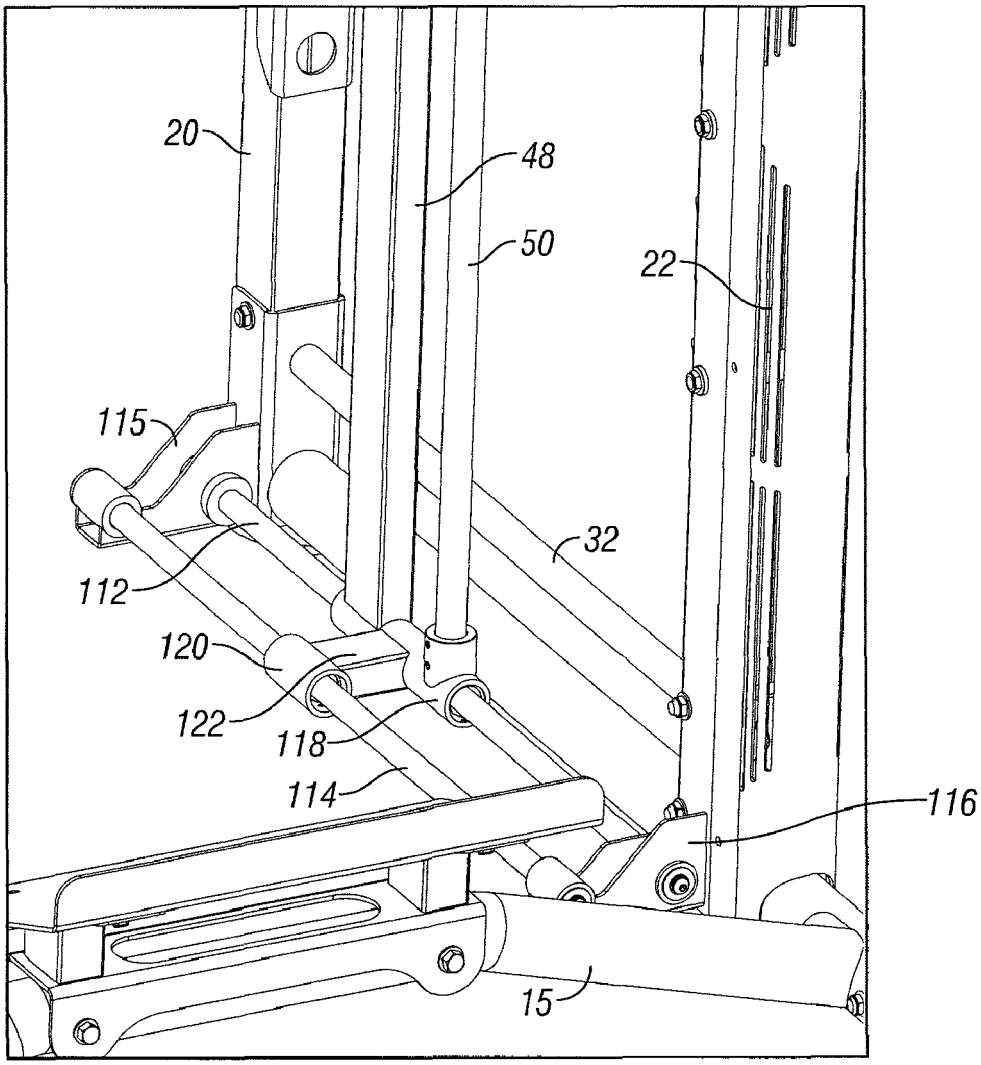
FIG. 30 is an enlarged, perspective view of the inside, lower part of one side frame of FIGS. 26 to 29, illustrating the horizontal slides of the traveling frame engaging the horizontal guides.
Figure 31:
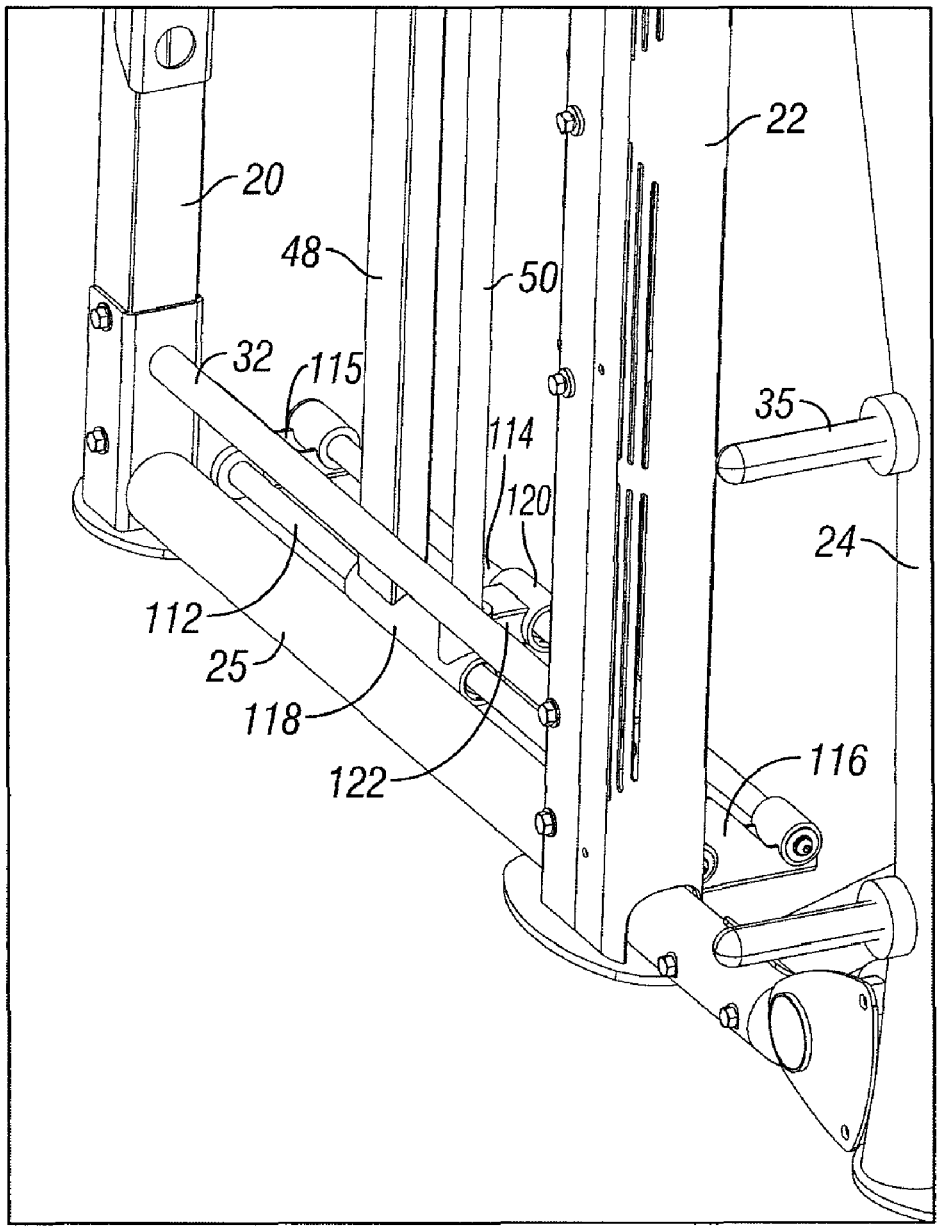
FIG. 31 is an enlarged view similar to FIG. 30 but illustrating the outside of the side frame.

In the first three embodiments, the horizontal slides 28, 30 were both horizontally and vertically offset, while in the previous embodiment the horizontal slides at the lower end of the main frame were vertically stacked or aligned, with no horizontal offset. In this embodiment, as best illustrated in FIGS. 30 and 31, there are two horizontal guides 112, 114 in spaced, horizontal alignment on each side of the frame, spaced inboard of the first base tube 25. The first and second horizontal guides are each secured at opposite ends to the first and second uprights 20, 22 of the stationary frame by brackets 115, 116, respectively, as illustrated in FIG. 30. The lower end of the vertical upright or strut 48 of the traveling frame is slidably mounted on the first horizontal guide 112 via first horizontal slide 118. The first horizontal slide 118 is secured to a second horizontal slide 120 slidably mounted on the second horizontal guide 114 via a stand-off 122. The lower end of the vertical guide 50 is rigidly secured to the first horizontal slide 118 in a similar manner to the first embodiment. The first horizontal slide contains two closed-style linear bearings, while the second horizontal slide 120 contains a single closed style linear bearing.

In each of the above embodiments, the vertical and horizontal slides may comprise sleeves containing linear bearings telescopically engaged over the respective vertical and horizontal guides or may alternatively comprise wheels, rollers, or other sliding devices. The above embodiments each use a dual, low position sliding guide system for increased rigidity, allowing for a smaller or lighter traveling frame. These embodiments do not require the racking system or safety bars to travel with the traveling frame. Instead, these parts are all separate and are either rigidly or adjustably connected to the main or stationary frame. Since the horizontal guide system is located only at the lower end of the machine, misalignment between upper and lower horizontal guides is not an issue and no system for compensation for such misalignment is provided.

In the above embodiments, the entire horizontal guidance system is located below the lowest travel point of the exercise bar, eliminating the need for overhead support or overhead horizontal slides and guides. In each embodiment, simultaneous guided horizontal and vertical movement of an exercise bar is provided. The dual low position horizontal guides on each side of the frame provide added rigidity without the use of overhead components, reducing the weight of the traveling frame and lessening the inertia required to initiate or change direction on the horizontal plane. The dual low position horizontal guides may be horizontally spaced, vertically spaced, or both horizontally and vertically spaced.

Components from the various embodiments can be intermixed and different types and numbers of bearings or wheels can be used for either the first or second horizontal slide. Different forms of horizontal guides or different guide positions may be used in alternative embodiments.

The weightlifting exercise machines described above have a traveling exercise unit of reduced overall weight and provide a smoother, more fluid exercise motion. The machine of this invention requires fewer horizontal slides and guides than many prior art designs, and also requires fewer vertical slides and guides than some prior art arrangements. It also requires less traveling framework than some prior designs.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A dual action weightlifting machine, comprising:

a stationary main frame assembly having a lower end and an upper end, the frame assembly comprising a right side frame and a left side frame on opposite sides of an exercise area;

a traveling frame movably supported on the stationary frame assembly and having right and left sides each having a lower end and an upper end, each side having a vertical guide;

a weight bearing exercise bar movably supported on the traveling frame and having a user engaging portion and spaced first and second vertical slides slidably mounted on the right and left vertical guides for vertical sliding movement relative to the traveling frame in a vertical travel path;

a horizontal slide assembly which slidably connects the traveling frame to the right and left side frames of the stationary frame assembly, the horizontal slide assembly being located in a lower portion of the stationary frame assembly completely below the vertical travel path of the user engaging portion of the weight bearing exercise bar, the traveling frame having no connection to the stationary frame assembly above the horizontal slide assembly when in an exercise ready position; and the horizontal slide assembly comprising a right pair of parallel, first and second horizontal guides associated with a lower portion of the right side frame, first and second horizontal slides on the right side of the traveling frame slidably engaging the respective first and second horizontal guides on the right side frame, a left pair of parallel first and second horizontal guides associated with a lower portion of the left side frame, and first and second horizontal slides on the left side of the traveling frame slidably engaging the respective first and second horizontal guides on the left side frame.

2. The machine of claim 1, wherein the first horizontal guide of each pair on each side frame is offset vertically and horizontally from the second horizontal guide of the respective pair.

3. The machine of claim 1, wherein the first and second horizontal guides of each pair on each side frame are vertically spaced in the same vertical plane.

4. The machine of claim 1, wherein the first and second horizontal guides on each side frame are positioned side-by-side in the same horizontal plane.

5. The machine of claim 1, wherein each horizontal slide comprises at least one linear bearing.

6. The machine of claim 1, wherein at least one horizontal slide on each side of the frame comprises a roller wheel assembly.

7. The machine of claim 1, wherein each side of the traveling frame further comprises an upright strut extending parallel to the vertical guide, the upright strut having a lower end secured to at least one horizontal slide.

8. The machine of claim 7, further comprising a single upper cross bar extending between the opposite sides of the traveling frame above the exercise area.

9. The machine of claim 7, wherein the right vertical guide has a lower end secured to one of the horizontal slides on the right side of the traveling frame and the left vertical guide has a lower end secured to one of the horizontal slides on the left side of the traveling frame.

10. The machine of claim 9, further comprising a first stand-off connecting the first and second horizontal slides on the right side of the traveling frame and a second stand-off connecting the first and second horizontal slides on the left side of the traveling frame.

11. The machine of claim 7, wherein the vertical guide has a lower end secured to the upright strut.

12. The machine of claim 7, wherein the lower end of each upright strut is secured to both horizontal slides on the respective side of the traveling frame.

13. The machine of claim 1, further comprising a stop mechanism on each side of the stationary frame defining the lowermost travel point of the vertical travel path of the user engaging portion of the exercise bar, the horizontal slide assembly being located completely below the stop mechanism.

14. The machine of claim 1, wherein the stationary frame assembly further comprises a lower horizontal cross bar extending between the side frames across a rear end of the exercise area, and a lunge plate mounted on the lower horizontal cross bar.

15. The machine of claim 1, wherein each side frame comprises a first floor engaging vertical upright and a second floor engaging vertical upright, each horizontal guide spanning at least a substantial portion of the distance between the first and second vertical uprights.

16. The machine of claim 1, wherein the stationary frame assembly further comprises a racking mechanism which supports the exercise bar in a selected racking position when the traveling frame is in a rest position.

17. A dual action weightlifting machine, comprising:

a stationary main frame assembly having a lower end and an upper end, the frame assembly comprising a right side frame and a left side frame on opposite sides of an exercise area;

a traveling frame movably supported on the stationary frame assembly and having right and left sides each having a lower end and an upper end, each side having a vertical guide;

a weight bearing exercise bar movably supported on the traveling frame and having a user engaging portion and spaced first and second vertical slides slidably mounted on the right and left vertical guides for vertical sliding movement relative to the traveling frame in a vertical travel path;

a horizontal slide assembly which slidably connects the traveling frame to the right and left side frames of the stationary frame assembly for horizontal sliding movement of the right and left sides of the traveling frame relative to the respective right and left side frames, the horizontal slide assembly being located in a lower portion of the stationary frame assembly completely below the vertical travel path of the user engaging portion of the weight bearing exercise bar, the traveling frame having no connection to the stationary frame assembly above the horizontal slide assembly when in an exercise ready position; and each side frame of the stationary frame assembly having at least one stop member above the horizontal slide assembly which defines the lowermost end of the vertical travel path of the user engaging portion of the weight bearing exercise bar.

18. The machine of claim 17, wherein the stop mechanism on each side of the frame comprises at least one stationary stop bar rigidly secured to the respective side frame.

19. The machine of claim 17, wherein the stop mechanism on each side of the frame comprises an adjustable stop bar adjustably secured to the respective side frame.

20. The machine of claim 19, wherein each side frame comprises first and second spaced uprights having a ground-engaging lower end, each stop bar extending between the first and second uprights.

21. A dual action weightlifting machine, comprising:

a stationary main frame assembly having a lower end, an upper end, and opposite right and left side frames on opposite sides of an exercise area, each side frame portion having at least one ground engaging upright strut;

a traveling frame movably supported on the stationary frame assembly and having right and left sides each having a lower end and an upper end, each side having a vertical guide;

a weight bearing exercise bar movably supported on the traveling frame and having a user engaging portion and spaced first and second vertical slides slidably mounted on the right and left vertical guides for vertical sliding movement relative to the traveling frame in a vertical travel path;

a horizontal slide assembly which slidably connects the traveling frame to the right and left side frames of the stationary frame assembly, the horizontal slide assembly being located in a lower portion of the stationary frame assembly completely below the vertical travel path of the user engaging portion of the weight bearing exercise bar, the traveling frame having no connection to the stationary frame assembly above the horizontal slide assembly when in an exercise ready position; and said one upright strut of each side frame of the stationary main frame having a racking mechanism facing the traveling frame which directly engages the exercise bar in a rest position of the traveling frame adjacent the upright struts.

22. The machine of claim 21, wherein each side frame has first and second spaced upright struts, the racking mechanism comprising a series of vertically spaced teeth on each second upright strut facing the traveling frame, the teeth defining spaced rest positions, whereby the exercise bar directly engages a selected aligned pair of teeth on the second upright struts in a selected rest position.

23. The machine of claim 21, wherein the stationary frame assembly further comprises a rear support frame which supports the upright struts, the rear support frame comprising a floor engaging rear upright on each side of the frame, each rear upright curving upwardly and forwardly and having an upper end connected to the respective upright strut.

24. The machine of claim 23, further comprising a plurality of weight pegs for weight storage on each rear upright.

25. A dual action weightlifting machine, comprising:

a stationary main frame having a lower end and an upper end, the frame assembly comprising a right side frame portion and a left side frame portion on opposite sides of an exercise area;

a traveling frame movably supported on the stationary frame and having right and left sides each having a lower end and an upper end, each side having a vertical guide;

a weight bearing exercise bar movably supported on the traveling frame and having a user engaging portion and spaced first and second vertical slides slidably mounted on the right and left vertical guides for vertical sliding movement relative to the traveling frame in a vertical travel path;

a horizontal slide assembly which slidably connects the traveling frame to the right and left side frame portions of the stationary frame, the horizontal slide assembly being located in a lower portion of the stationary frame below the vertical travel path of the user engaging portion of the weight bearing exercise bar, the traveling frame having no connection to the stationary frame above the horizontal slide assembly when in an exercise ready position;

the stationary main frame having a racking portion which directly engages and supports the exercise bar in a rest position of the traveling frame; and each side of one of the frames having at least one stop member above the horizontal slide assembly which defines the lowermost end of the vertical travel path of the weight bearing exercise bar.

* * * * *